US009031686B2

(12) United States Patent
Tokura

(10) Patent No.: US 9,031,686 B2
(45) Date of Patent: May 12, 2015

(54) EMBROIDERY DATA PROCESSOR, COMPUTER-READABLE STORAGE MEDIUM STORING EMBROIDERY DATA PROCESSING PROGRAM AND SEWING MACHINE

(71) Applicant: Masashi Tokura, Konan (JP)

(72) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/016,813

(22) Filed: Sep. 3, 2013

(65) Prior Publication Data

US 2014/0069308 A1 Mar. 13, 2014

(30) Foreign Application Priority Data

Sep. 10, 2012 (JP) ..... 2012-198420

(51) Int. Cl.

| | |
|---|---|
| ***D05B 19/00*** | (2006.01) |
| ***D05B 19/02*** | (2006.01) |
| ***D05B 19/10*** | (2006.01) |
| ***D05C 5/06*** | (2006.01) |

(52) U.S. Cl.
CPC ..... *D05B 19/02* (2013.01); *D05B 19/10* (2013.01); *D05C 5/06* (2013.01)

(58) Field of Classification Search
USPC ..... 700/136–138; 112/470.01, 470.04, 112/470.06, 475.18, 475.19
See application file for complete search history.

(56) References Cited

U.S. PATENT DOCUMENTS

| | | | | |
|---|---|---|---|---|
| 4,869,188 | A * | 9/1989 | Hyodo | 112/445 |
| 5,410,976 | A * | 5/1995 | Matsubara | 112/102.5 |
| 5,740,057 | A * | 4/1998 | Futamura | 700/138 |
| 5,751,583 | A * | 5/1998 | Kyuno et al. | 700/137 |
| 5,954,004 | A * | 9/1999 | Futamura | 112/102.5 |

(Continued)

FOREIGN PATENT DOCUMENTS

| | | |
|---|---|---|
| JP | A-6-327867 | 11/1994 |
| JP | A-6-327874 | 11/1994 |

(Continued)

OTHER PUBLICATIONS

Rasenkaidan, User's Guide and Overview of Electric Quilt 6 Software including "Concise Explanation of Relevance for Lesson 2 of The User's Guide to Electric Quilt Software 6", retreived on Oct. 18, 2010 by same assignor within co-pending U.S. Appl. No. 13/361,401, 21 pages.*

*Primary Examiner* — Danny Worrell
(74) *Attorney, Agent, or Firm* — Oliff PLC

(57) ABSTRACT

An embroidery data processor includes a color information acquiring unit configured to acquire color information of a workpiece cloth on which an embroidery pattern composed of a plurality of color-based pattern portions is sewn, a color storage unit configured to store data of defined colors, an assignment unit configured to randomly extract colors from the colors stored by the color storage unit for every color-based pattern portion, the extracted colors being used as thread color data specifying colors of the color-based pattern portions respectively, the assignment unit assigning the extracted colors to the respective color-based pattern portions, and a setting unit configured to set a predetermined extraction range containing a similar color or a contrast color based on the color information acquired by the acquiring unit. The assignment unit is configured to extract the color stored by the color storage unit in the set extraction range.

10 Claims, 15 Drawing Sheets

(56) References Cited

U.S. PATENT DOCUMENTS

| | | | | |
|---|---|---|---|---|
| 6,012,402 | A * | 1/2000 | Sekine | 112/102.5 |
| 6,304,793 | B1 * | 10/2001 | Komiya et al. | 700/138 |
| 6,321,670 | B1 * | 11/2001 | Tomita et al. | 112/475.19 |
| 6,324,441 | B1 * | 11/2001 | Yamada | 700/138 |
| RE38,718 | E * | 3/2005 | Futamura | 700/138 |
| 6,980,877 | B1 * | 12/2005 | Hagino et al. | 700/138 |
| 7,228,195 | B2 * | 6/2007 | Hagino | 700/138 |
| 7,503,271 | B2 * | 3/2009 | Hayakawa | 112/470.01 |
| 7,542,822 | B2 * | 6/2009 | Kawaguchi et al. | 700/138 |
| 8,682,467 | B2 * | 3/2014 | Ihira et al. | 700/138 |
| 8,694,147 | B2 * | 4/2014 | Okuyama | 700/138 |
| 8,731,705 | B2 * | 5/2014 | Maki | 700/138 |
| 8,774,957 | B2 * | 7/2014 | Maki et al. | 700/138 |
| 8,793,009 | B2 * | 7/2014 | Ihira | 700/138 |
| 8,818,546 | B2 * | 8/2014 | Kato | 700/138 |
| 2005/0188906 | A1 * | 9/2005 | Goto et al. | 112/102.5 |
| 2007/0199492 | A1 * | 8/2007 | Ishii | 112/303 |
| 2008/0196645 | A1 * | 8/2008 | Ikeba et al. | 112/470.01 |
| 2008/0223274 | A1 * | 9/2008 | Okuyama | 112/102.5 |
| 2012/0197430 | A1 * | 8/2012 | Maki et al. | 700/138 |
| 2014/0069308 | A1 * | 3/2014 | Tokura | 112/102.5 |

FOREIGN PATENT DOCUMENTS

| | | |
|---|---|---|
| JP | A-11-57262 | 3/1999 |
| JP | A-11-244560 | 9/1999 |

* cited by examiner

| EMBROIDERY DATA | |
|---|---|
| FIRST PATTERN PORTION DATA | PATTERN 1 PURPLE |
| | Xa0, Ya0 |
| | Xa1, Ya1 |
| | Xa2, Ya2 |
| | ⋮ |
| | XaN, YaN |
| SECOND PATTERN PORTION DATA | PATTERN 2 PINK |
| | Xb0, Yb0 |
| | Xb1, Yb1 |
| | Xb2, Yb2 |
| | ⋮ |
| | XbN, YbN |
| THIRD PATTERN PORTION DATA | PATTERN 3 MAGENTA |
| | Xc0, Yc0 |
| | Xc1, Yc1 |
| | Xc2, Yc2 |
| | ⋮ |
| | XcN, YcN |
| ⋮ | ⋮ |
| n-TH PATTERN PORTION DATA | PATTERN n RED |
| | Xn0, Yn0 |
| | Xn1, Yn1 |
| | Xn2, Yn2 |
| | ⋮ |
| | XnN, YnN |

FIG. 5

EMBROIDERY DATA PROCESSOR, COMPUTER-READABLE STORAGE MEDIUM STORING EMBROIDERY DATA PROCESSING PROGRAM AND SEWING MACHINE

CROSS-REFERENCE TO RELATED APPLICATIONS

This application is based upon and claims the benefit of priority from the prior Japanese Patent Application No. 2012-198420 filed on Sep. 10, 2012, the entire contents of which are incorporated herein by reference.

BACKGROUND

1. Technical Field

The present disclosure relates to an embroidery data processor processing embroidery data on which an embroidery pattern is sewn by a sewing machine, a computer-readable storage medium storing an embroidery data processing program, and a sewing machine capable of sewing an embroidery pattern.

2. Related Art

There has conventionally been known a sewing machine which sews an embroidery pattern based on embroidery data. A plurality of data of embroidery patterns is stored in a storage device incorporated in the sewing machine or an external storage device such as memory card. A user selects a desirable one of the embroidery patterns. The sewing machine enters the embroidery data of the selected embroidery pattern and sews the embroidery pattern on a workpiece cloth, while transferring an embroidery frame holding the workpiece cloth by a transfer mechanism.

Embroidery patterns include a first type including a plurality of color pattern portions sewn in different colors (thread colors) and a second type sewn in a single color. The color pattern portions in the first type embroidery patterns are set to predetermined colors respectively. Some types of embroidery data editing devices are configured to store color combination data indicative of preferred color combinations. Colors of the color pattern portions of an embroidery pattern are set based on the color combination data and cloth data indicative of a color of cloth (workpiece cloth) and the like.

In the above-described embroidery data editing device, colors of the color pattern portions of the embroidery pattern are determined in an unequivocal manner on the basis of a color of the cloth and color combination data. However, the user sometimes wishes to sew an embroidery pattern in favorite colors which do not correspond with the predetermined colors or in eccentric colors regarding the colors of the color pattern portions. When colors of the embroidery pattern are specified in this manner, that is, without relying on the predetermined colors, data of the color pattern portions are required to be read one by one. Regarding each read data, the corresponding thread color data needs to be confirmed and specified, with the result that the color editing manner is time-consuming and troublesome.

SUMMARY

Therefore, an object of the disclosure is to provide an embroidery data processor which can easily provide a variety of color patterns according to the color of workpiece cloth regarding an embroidery pattern, a computer-readable storage medium storing an embroidery data processing program usable with the embroidery data processor, and a sewing machine usable with the embroidery data processor.

The present disclosure provides an embroidery data processor processing embroidery data on which an embroidery pattern is sewn by a sewing machine. The processor comprises a color information acquiring unit which is configured to acquire color information of a workpiece cloth on which the embroidery pattern composed of a plurality of color-based pattern portions is sewn, a color storage unit which is configured to store data of a plurality of defined colors, an assignment unit which is configured to randomly extract colors from the colors stored by the color storage unit for every one of the color-based pattern portions, based on the color information acquired by the color information acquiring unit, the extracted colors being used as thread color data specifying colors of the color-based pattern portions respectively, the assignment unit assigning the extracted colors to the respective color-based pattern portions, and a setting unit configured to set a predetermined extraction range containing a similar color or a contrast color based on the color information acquired by the color information acquiring unit. The assignment unit is configured to extract the color stored by the color storage unit in the extraction range set by the setting unit.

BRIEF DESCRIPTION OF THE DRAWINGS

In the accompanying drawings:

FIG. 5 illustrates embroidery data;

DETAILED DESCRIPTION

Figure 1:
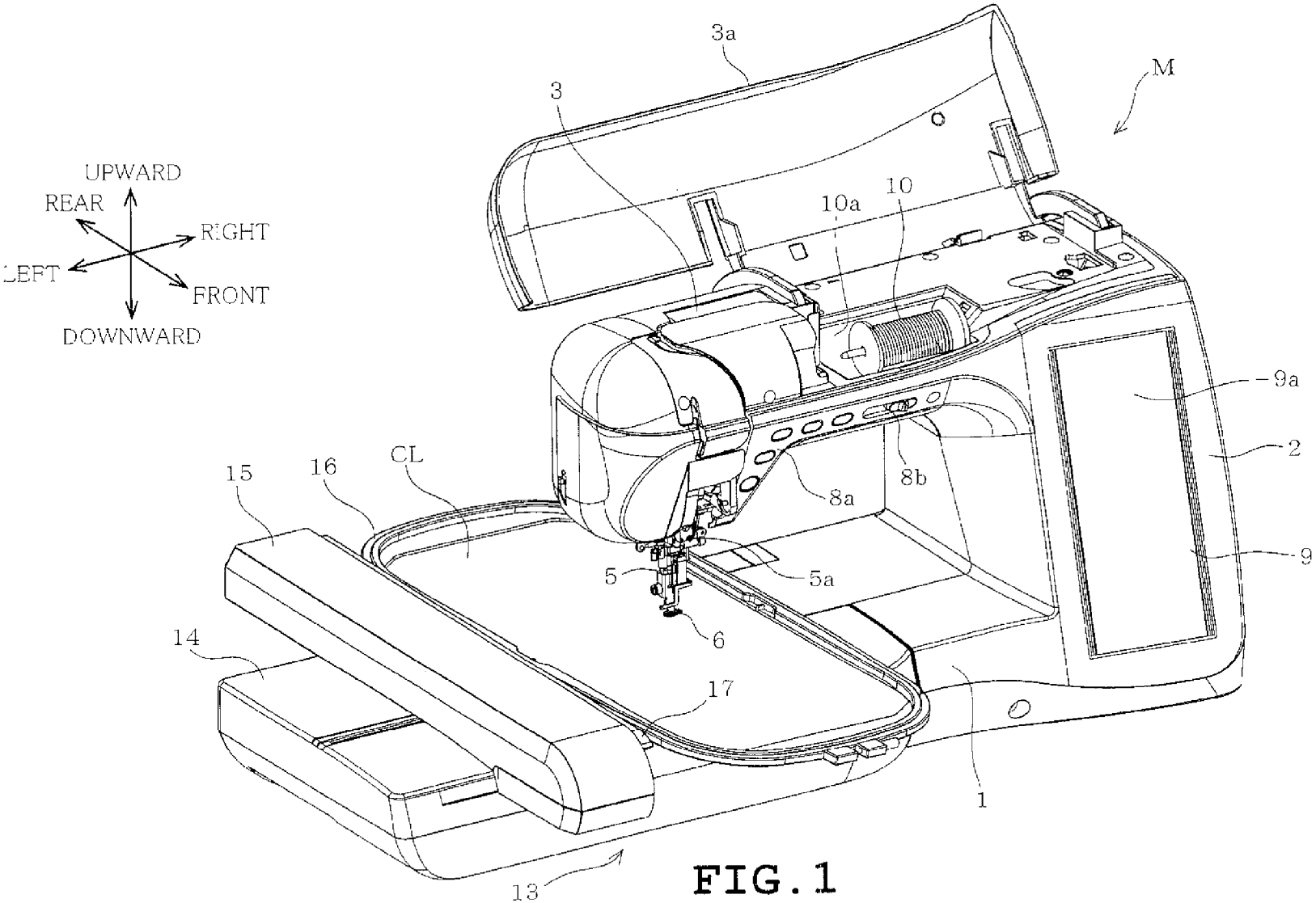
FIG. 1 is a perspective view showing an appearance of sewing machine according to one example.

An example of household sewing machine (hereinafter, "sewing machine M") will be described with reference to the accompanying drawings. Referring to FIG. 1, the sewing machine M includes a bed 1 extending in a right-left direction, a pillar 2 standing from a right end of the bed 1 and an arm 3 extending leftward from an upper part of the pillar 2, all of which are formed integrally with one another. The arm 3 houses a sewing machine shaft (not shown) extending in the right-left direction and a sewing machine motor 4 (see FIG. 3) which rotates the machine shaft. The side where switches or display unit both of which will be described later is located relative to the sewing machine M will be referred to as "front" and the side opposed to the front will be referred to as "rear."

The side where the pillar 2 is located will be referred to as "right side" and the side opposed to the right side will be referred to as "left side."

Figure 2:
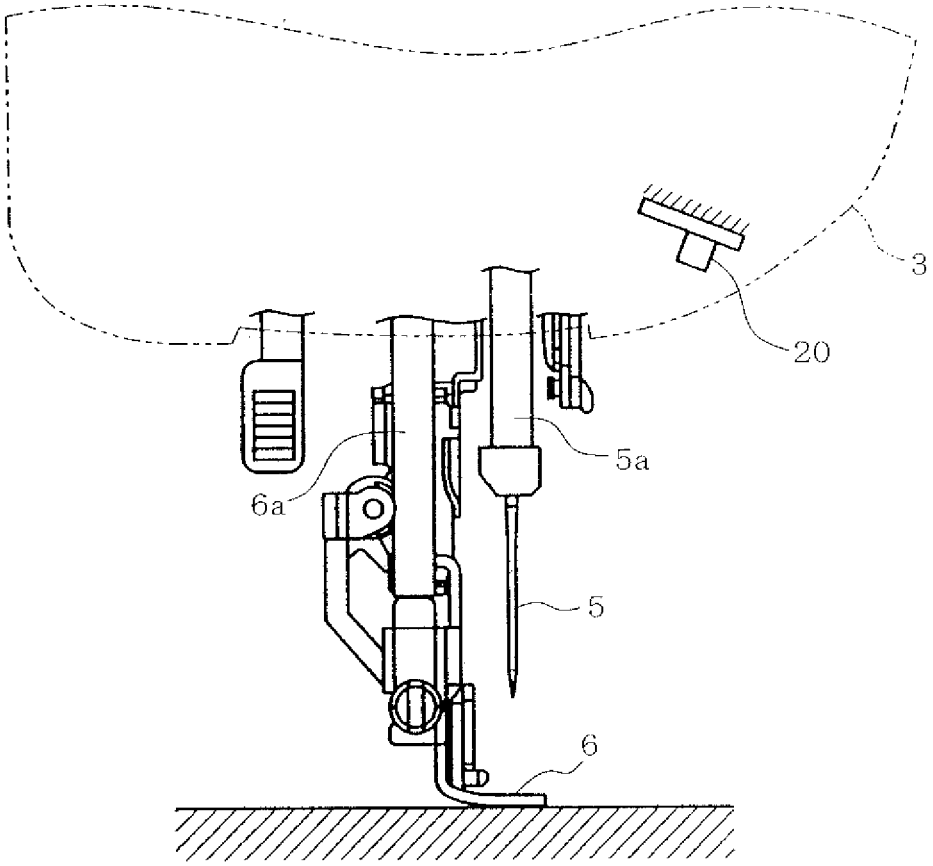
FIG. 2 is a left side elevation of a distal end side of arm of the sewing machine, showing arrangement of a camera.

The arm 3 has a distal end on which are mounted a needle bar 5*a* having a lower end to which a needle 5 is attached and a presser bar 6*a* (not shown) having a lower end provided with a presser foot 6, as shown in FIGS. 1 and 2. The arm 3 also houses a needle bar driving mechanism which moves the needle bar 5*a* upward and downward based on rotation of the machine shaft and a needle bar swinging mechanism which swings the needle bar 5*a* in a direction (the right-left direction) perpendicular to a cloth feed direction. The arm 3 further houses a needle thread take-up driving mechanism which moves a needle thread take-up (not shown) upward and downward in synchronization with the upward and downward movement of the needle bar 5*a*, a presser bar driving mechanism which moves the presser bar 6*a* upward and downward, and the like.

The arm 3 is provided with a cover 3*a* which is pivotally mounted thereon to open and close an upper surface side thereof. An accommodating space 10*a* is defined in the central front of the arm 3 so as to accommodate a thread spool 10 when the cover 3*a* is in an open state. A needle thread drawn from the thread spool 10 is supplied through a thread supply passage including the needle thread take-up and the like to the needle 5. On the front side of the arm 3 are mounted various switches including a start/stop switch 8*a* which is operable to start or stop a sewing work. A speed adjusting knob 8*b* is also mounted on the front side of the arm 3 to adjust a sewing speed or a rotational speed of the machine shaft.

A large sized vertically long display 9 capable of full color display is provided on the front of the pillar 2. In other words, the display 9 serves as a display unit displaying information by multiple colors. The display 9 is configured to display various sewing patterns such as ordinary patterns or embroidery patterns, names of functions to be executed in the sewing work, a setting screen for setting regarding a coloration process as will be described later, and the like. The display 9 has a front to which is mounted a touch panel 9*a* (see FIG. 3) having a plurality of touch keys including transparent electrodes. The touch keys are depressed by user's finger or a touch pen (not shown). The depression of the touch keys will hereinafter be referred to as "touch operation." Thus, selection of a sewing pattern, instruction of various functions, setting of various parameters or the like is realized by the touch operation.

The pillar 2 has a right side surface in which is formed a card slot 12 (see FIG. 3) into which a memory card 11 storing embroidery data of various embroidery patterns and the like is insertable.

The bed 1 has an upper surface on which a needle plate (not shown) is mounted. The bed 1 houses a cloth feed mechanism which is located under the needle plate to move a feed dog vertically and horizontally, a horizontal rotating hook accommodating a bobbin and forming stitches in cooperation with the needle 5, a thread cutting mechanism which cuts the needle thread and the bobbin thread, and the like.

An embroidery frame transfer device 13 is detachably attached to a left part of the bed 1. The embroidery frame transfer device 13 includes a body 14 that is level with the upper surface of the bed 1 in an attached state thereof and a movable portion 15 which is mounted on an upper surface of the body 14 so as to be movable in the right-left direction. The movable portion 15 is provided with a carriage 17 which is movable in the front-back direction to detachably connect an embroidery frame 16 thereto. The embroidery frame 16 is configured to hold a workpiece cloth CL serving as an object to be sewn. In the body 14 is provided an X-direction transfer mechanism (not shown) which moves the carriage 17 in the right-left direction together with the movable portion 15 and a Y-direction transfer mechanism (not shown) which moves the carriage 17 in the front-back direction. The embroidery frame 16 is moved in the right-left or X direction and in the front-back or Y direction by driving drive motors of the respective X-direction and Y-direction transfer mechanisms (an X-axis motor 18 and a Y-axis motor 19 as will be described later; and see FIG. 3) on the basis of the embroidery data of the embroidery pattern.

The sewing machine M has a function of processing embroidery data which is used to sew an embroidery pattern. The sewing machine M is provided with a camera 20 which serves as an imaging unit which sets colors of embroidery data according to a color of the workpiece cloth CL, as shown in FIG. 2. More specifically, the camera 20 is constituted by a CMOS image sensor, for example. The camera 20 is incorporated in a distal end side of the arm 3 so as to be directed downward and configured to image the workpiece cloth CL held by the embroidery frame 16.

Figure 3:
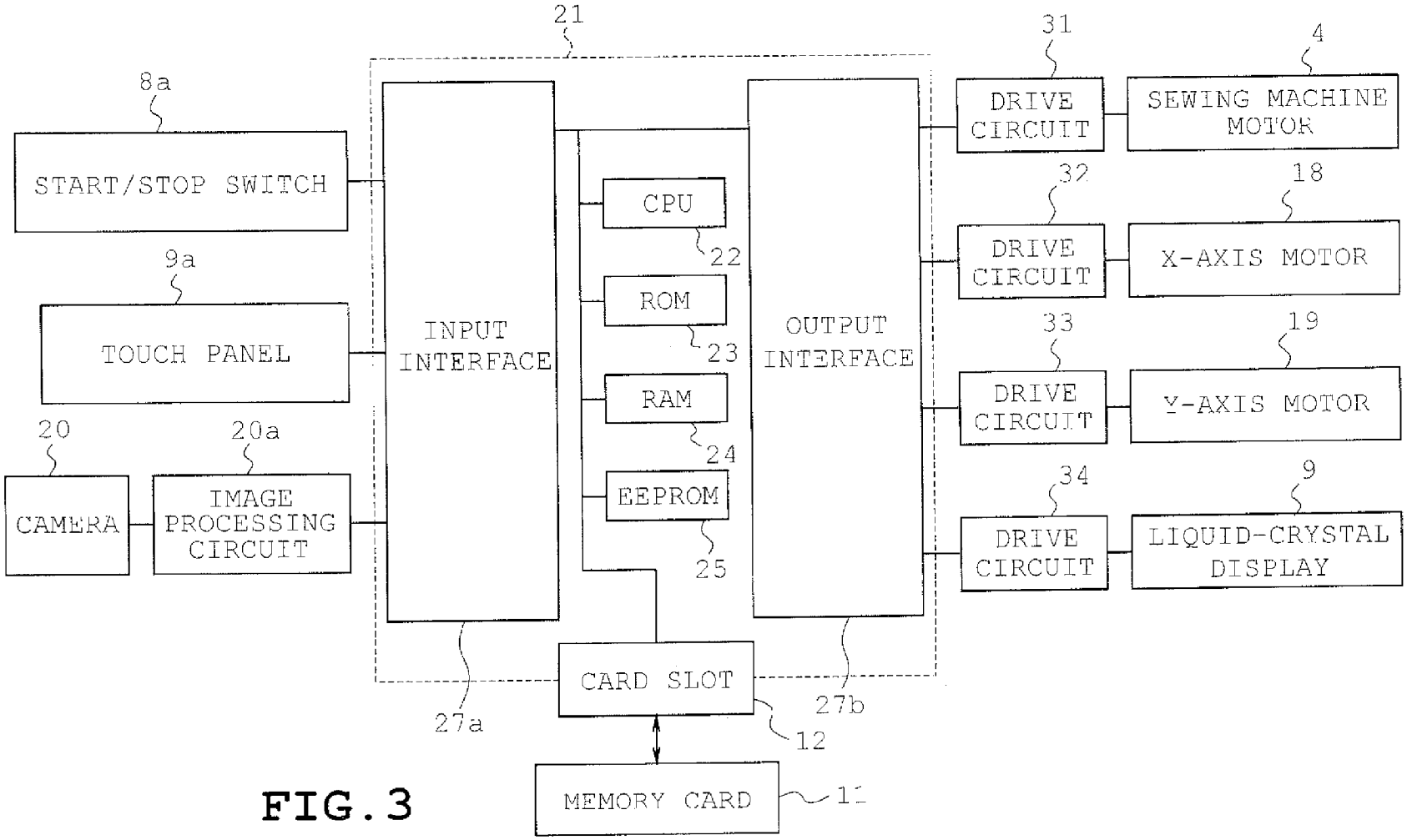
FIG. 3 is a block diagram showing an electrical arrangement of the sewing machine.

The arrangement of the control system of the sewing machine M will now be described with reference to the block diagram of FIG. 3. A control device or processor 21 is configured mainly with a microcomputer and incorporates a CPU 22, a ROM 23, a RAM 24, an EEPROM 25, the card slot 12, an input interface 27*a*, an output interface 27*b*, a bus bar 28 connecting between the input and output interfaces 27*a* and 27*b*, and the like. The start/stop switch 8*a*, the touch panel 9*a* and an image processing circuit 20*a* are connected to the input interface 27*a*. To the output interface 27*b* are connected drive circuits 31, 32, 33 and 34 driving the sewing machine motor 4, the X-axis motor 18, the Y-axis motor 19 and the display 9 respectively.

The camera 20 is connected to the image processing circuit 20*a*. Data of an image taken by the camera 20 is processed by the image processing circuit 20*a* to be supplied via the input interface 27*a* to the control device 21. The image processing includes a process of obtaining color information of the workpiece cloth CL, for example, by way of RGB values. The control device 21, the camera 20 and the image processing circuit 20*a* serve as a color information acquiring unit which acquires color information of the workpiece cloth CL. The control device 21, the display 9 and the drive circuit 34 serve as a display unit. An embroidery data processor 30 is constituted by the control device 21, the touch panel 9*a*, the display 9, the camera 20, the circuits 20*a* and 34, and the like.

The ROM 23 stores embroidery data, an embroidery data processing program, a sewing control program, a display control program and a table of full thread information. The embroidery data processing program causes the computer to function as various processing units to process embroidery data. The full thread information table relates to all pieces of information about a plurality of types of threads used for embroidery sewing and includes thread color information, thread numbers and the like as will be described later. The display control program is used to control the display 9. These programs and data may be stored by another storage unit. The storage unit may include an internal storage unit such as an EEPROM 25 and an external storage unit such as the memory card 11. For example, when the embroidery data processing program is assumed to be stored on the external storage unit, the control device 21 reads the program onto the RAM 24 to execute the program.

Figure 4:
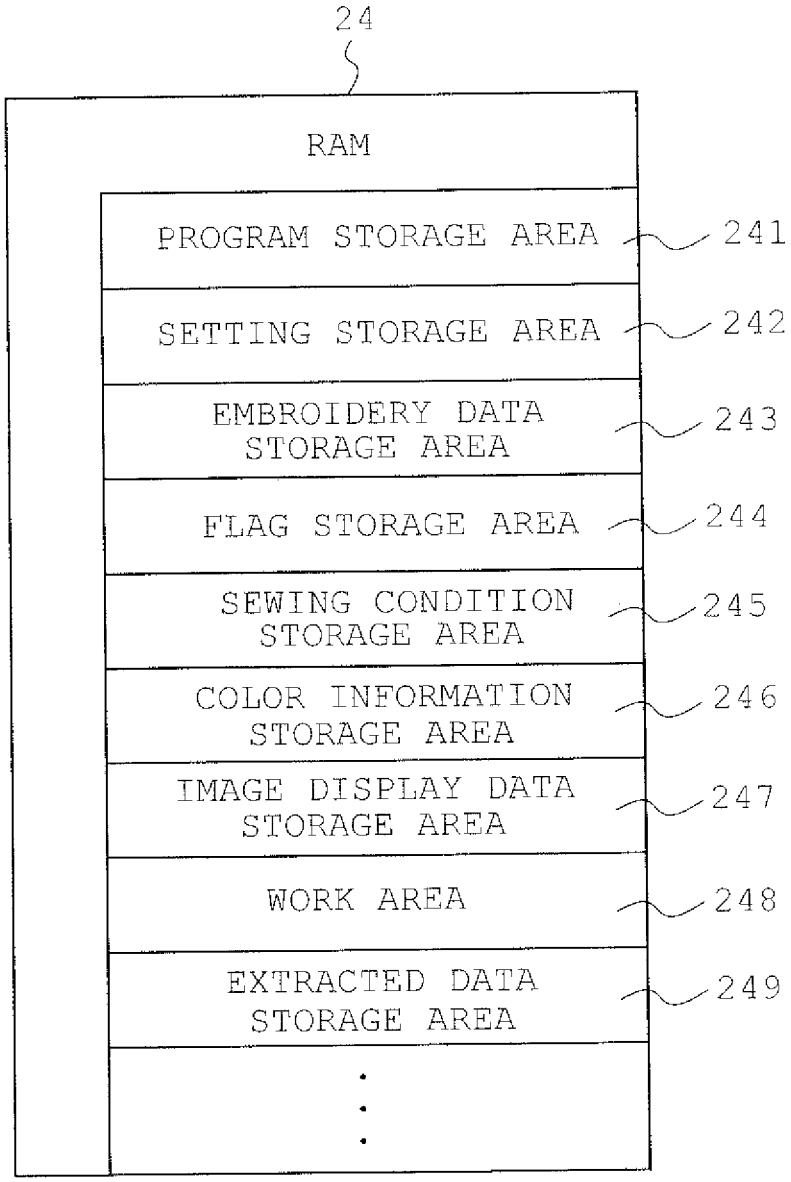
FIG. 4 is a conceptual diagram showing a storage area of RAM of the sewing machine.

The RAM 24 has a storage area for temporarily storing, as a storage unit, the aforementioned programs and data. The RAM 24 also has storage areas for storing various set values supplied by operation on the touch panel 9*a* and the like and results of calculation performed by the control device 21 and the like. In more detail, as shown in FIG. 4, the RAM 24 has a program storage area 241, a setting storage area 242, an embroidery data storage area 243, a flag storage area 244, a sewing condition storage area 245, a color information storage area 246, an image display data storage area 247, a work area 248, an extracted data storage area 249 and the like. The program storage area 241 stores various programs read from the ROM 23 or the like. The setting storage area 242 stores settings, tables and the like referred to during execution of a program. The embroidery data storage area 243 stores data serving as an original or a reference value in generation of embroidery data. The flag storage area 244 stores various flags used in execution of a program. The sewing condition storage area 245 stores various sewing conditions in the case of sewing an embroidery pattern.

The color information storage area 246 stores a pallet table and pallet-based color numbers both of which will be described later, and the like. The color information storage area 246 thus stores data used for coloration of an embroidery pattern. Furthermore, the extracted data storage area 249 temporarily stores data of a color randomly extracted from the pallet table or the like. The image display data storage area 247 stores image data of screens to be displayed on the display 9 and display settings. The work area 248 preliminarily stores settings and the like during execution of various programs.

Figure 9:
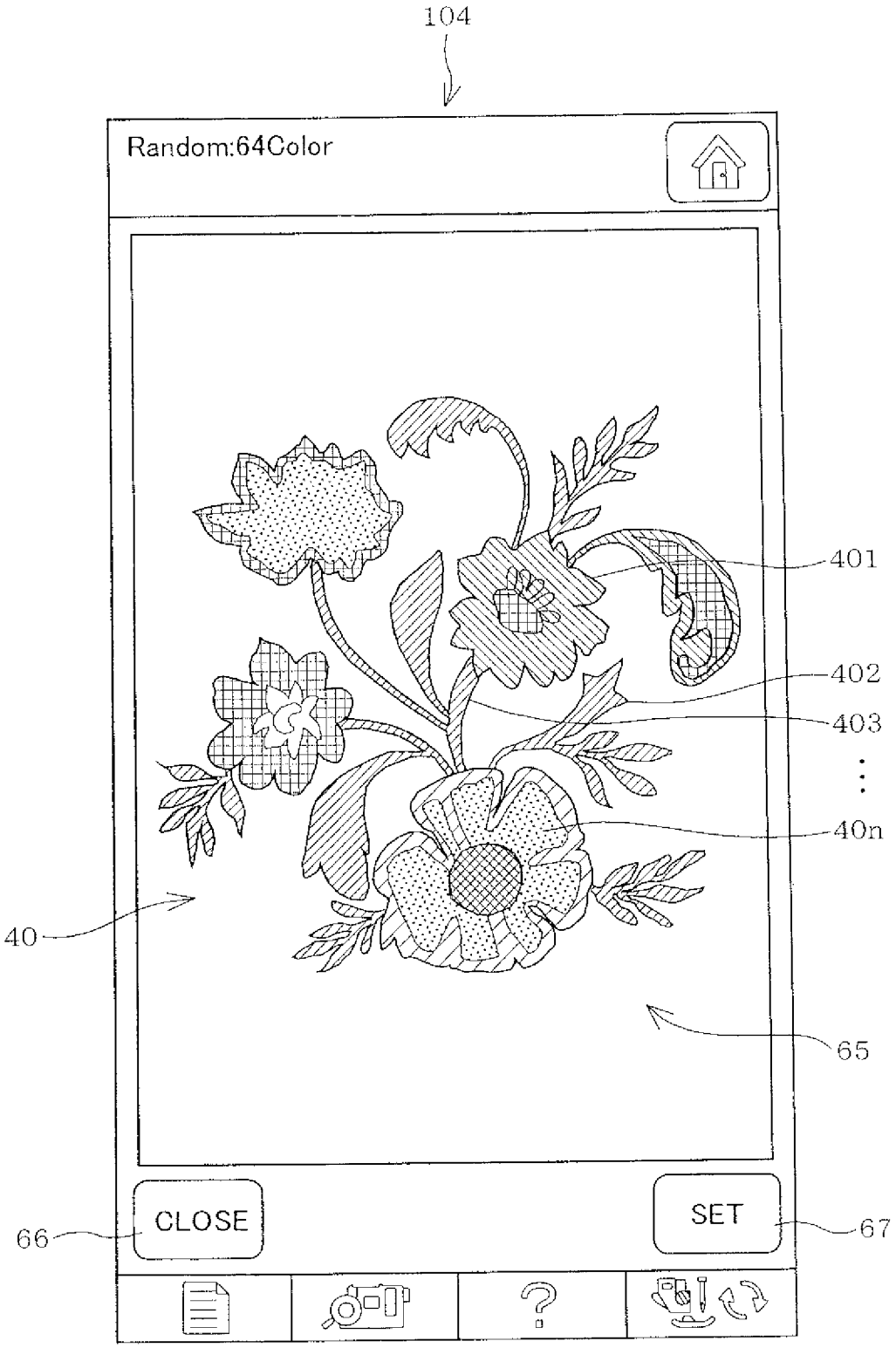
FIG. 9 illustrates an enlarged display screen.
Figure 10:
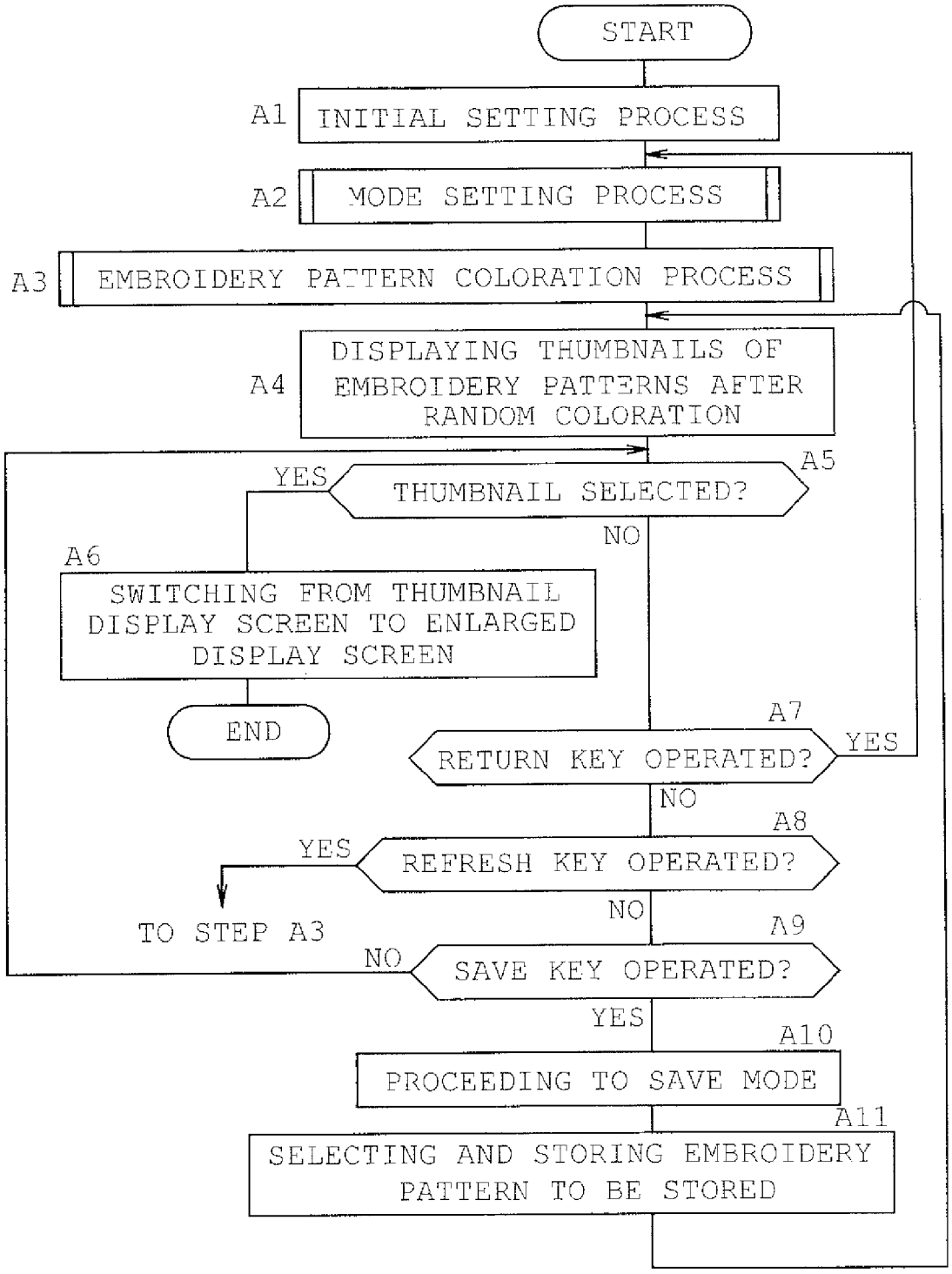
FIG. 10 is a flowchart showing setting of thread color data.

An embroidery pattern 40 of "flower" displayed on the screen 104 of the display 9 as shown in FIG. 9 will be described as an example of embroidery pattern. The embroidery pattern 40 includes first to n-th pattern portions 401 to 40*n* which are a plurality of (n number of) color-based pattern portions. More specifically, for example, a first pattern portion 401 composing flower petal is sewn by the use of a purple thread. A second pattern portion 402 composing a leaf is sewn by the use of a pink thread. A third pattern portion 403 composing a stalk is sewn by the use of a magenta thread. Thus, the pattern portions 401 to 40*n* are color-based pattern portions for which respective colors are set. The pattern portions 401 to 40*n* may or may not have colors different from one another.

Embroidery data is used for the sewing machine M to sew an embroidery pattern and includes data of a plurality of color-based pattern portions. For example, as shown in FIG. 5, embroidery data of the embroidery pattern 40 includes data of a plurality of needle locations set for respective pattern portions 401 to 40*n*, sewing sequence data to specify a sewing sequence of the pattern portions 401 to 40*n* and thread color data. The thread color data is used to specify a color for every color-based pattern portion, and a color is assigned from color information to the thread color data by an assigning unit which will be described later.

An uppermost sewing sequence data "pattern 1" in FIG. 5 is to specify a sequence of pattern to be initially sewn. "Purple" corresponding to the sequence is actually thread color data indicated by RGB values, for example. Furthermore, needle location data "Xa0, Ya0" . . . "XaN, YaN" is position coordinates where a needle corresponding to a purple thread sequentially drops. In the same manner, each of second and subsequent embroidery data includes sewing sequence data "pattern 2" to "pattern n," thread color data "pink" to "red" and needle location data "XbN, YbN" to "XnN, YnN." Furthermore, the embroidery data includes image data to be displayed on the display 9 (image data of bmp or the like, for example), and an image of embroidery pattern is displayed in colors assigned to respective thread color data on the display 9.

The EEPROM 25 stores information (color information) about a plurality of colors assigned as thread color data. The EEPROM 25 and the RAM 24 each serve as a color storage unit. Color information relates to thread colors of thread spools 10 which can be used with the sewing machine M and is defined as RGB values. More specifically, the EEPROM 25 stores a first pallet table (see a first color pallet 53 in FIG. 6) composed of RGB values of 64 colors and pallet-based color numbers of 1 to 64 corresponding to the respective RGB values. The EEPROM 25 also stores a second pallet table (not shown) of a plurality of colors selected from the color information by the user in addition to the first pallet data. The second pallet table is a custom pallet table including RGB values of up to 300 colors and pallet-based color numbers of 1 to 300 corresponding to the respective RGB values, both of which values are settable according to user's preference.

Furthermore, HSV values are also used in this example in addition to the RGB values. The HSV values are defined by hue, saturation and value in an HSV space, corresponding to the RGB values. The HSV values are computed on the basis of RGB values by a known obtaining method by the control device 21 and represented by values of hue H, saturation S and value V. In this case, the hue represents a type of color such as red, purple, blue, etc. and has a value ranging from 0 to 360, for example. The saturation represents color vividness and has a value ranging from 0.0 to 1.0. The value represents color brightness and has a value ranging from 0.0 to 1.0.

Screens displayed on the display 9 in generating embroidery data or in particular, coloration of thread color data will be described with reference to FIGS. 6 to 9 in addition to FIGS. 1 to 5. FIGS. 6 to 9 explain display screens 101 to 104 of the display 9. Since the display 9 is a liquid crystal color display, images of embroidery patterns, the first color pallet 53, and the like on the screens 101 to 104 are displayable in multiple colors.

Figure 6:
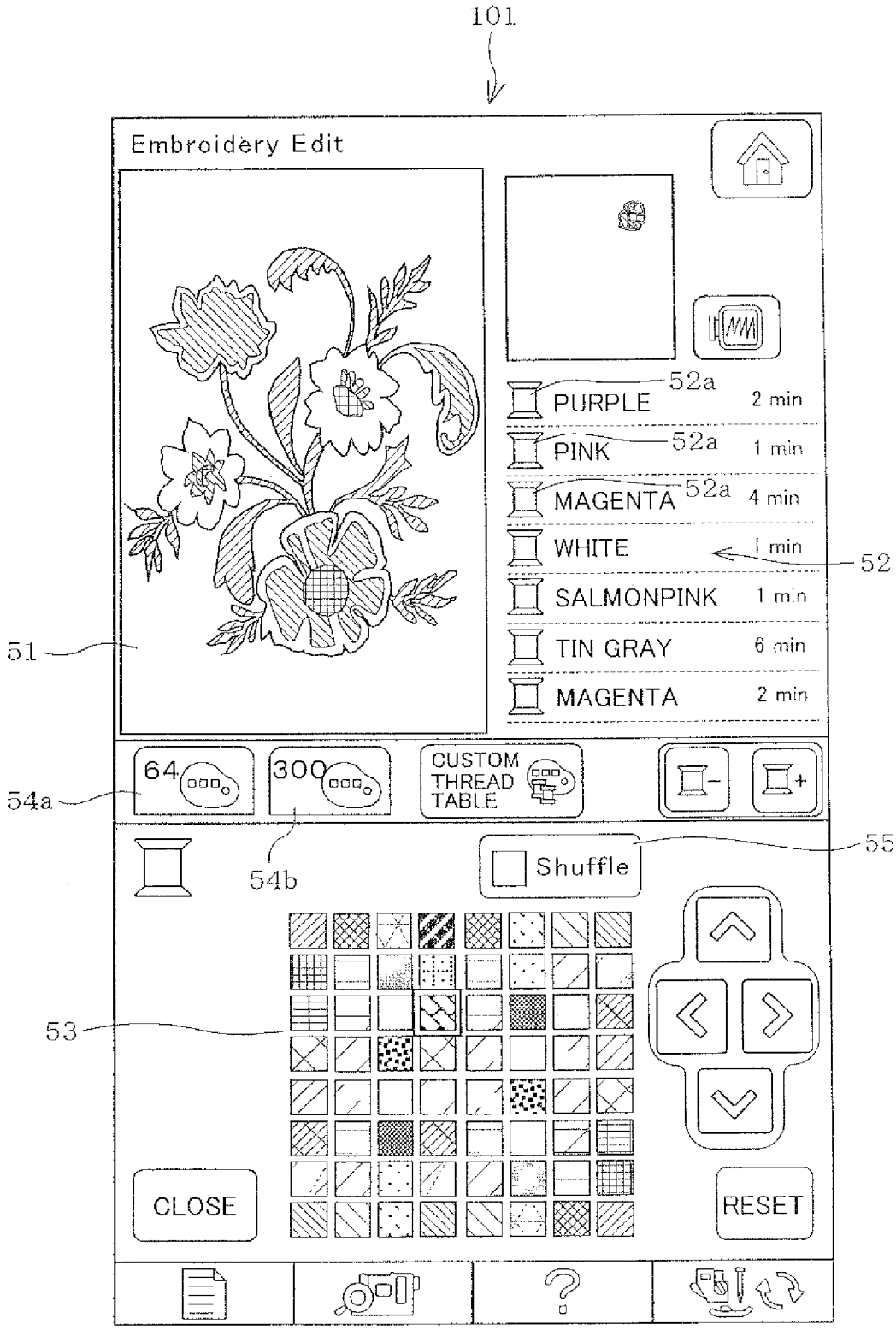
FIG. 6 illustrates a first color change screen.

FIG. 6 exemplifies the first color change screen 101 displayed in the coloration of thread color data. The first color change screen 101 is provided with a preview image area 51 and a thread color data designation area 52, the first color pallet 53, a plurality of pallet selecting keys 54*a* and 54*b* and a shuffle key 55. A preview image displayed in the preview image area 51 shows a result of embroidering in the case where embroidering is executed on the embroidery data corresponding to an embroidery pattern selected by the user.

Various settings regarding a thread color are settable on the first color change screen 101. More specifically, the thread color data designation area 52 shows colors corresponding to color-based pattern portions of the embroidery pattern in the preview image area 51, together with an illustration of the thread spool 52*a*. When touching the touch key corresponding to the thread spool 52*a*, the user can designate a desirable color in the first color pallet 53 for every color-based pattern portion. For example, the first color pallet 53 has a top row to which RGB values of pallet-based color numbers 1 to 8 of the first pallet table are assigned sequentially from the left one respectively, as shown in FIG. 6. Thus, the first color pallet 53 is a 64-color pallet in which eight pieces of color information are assigned to each of eight rows from the top row to the bottom row.

Figure 7:
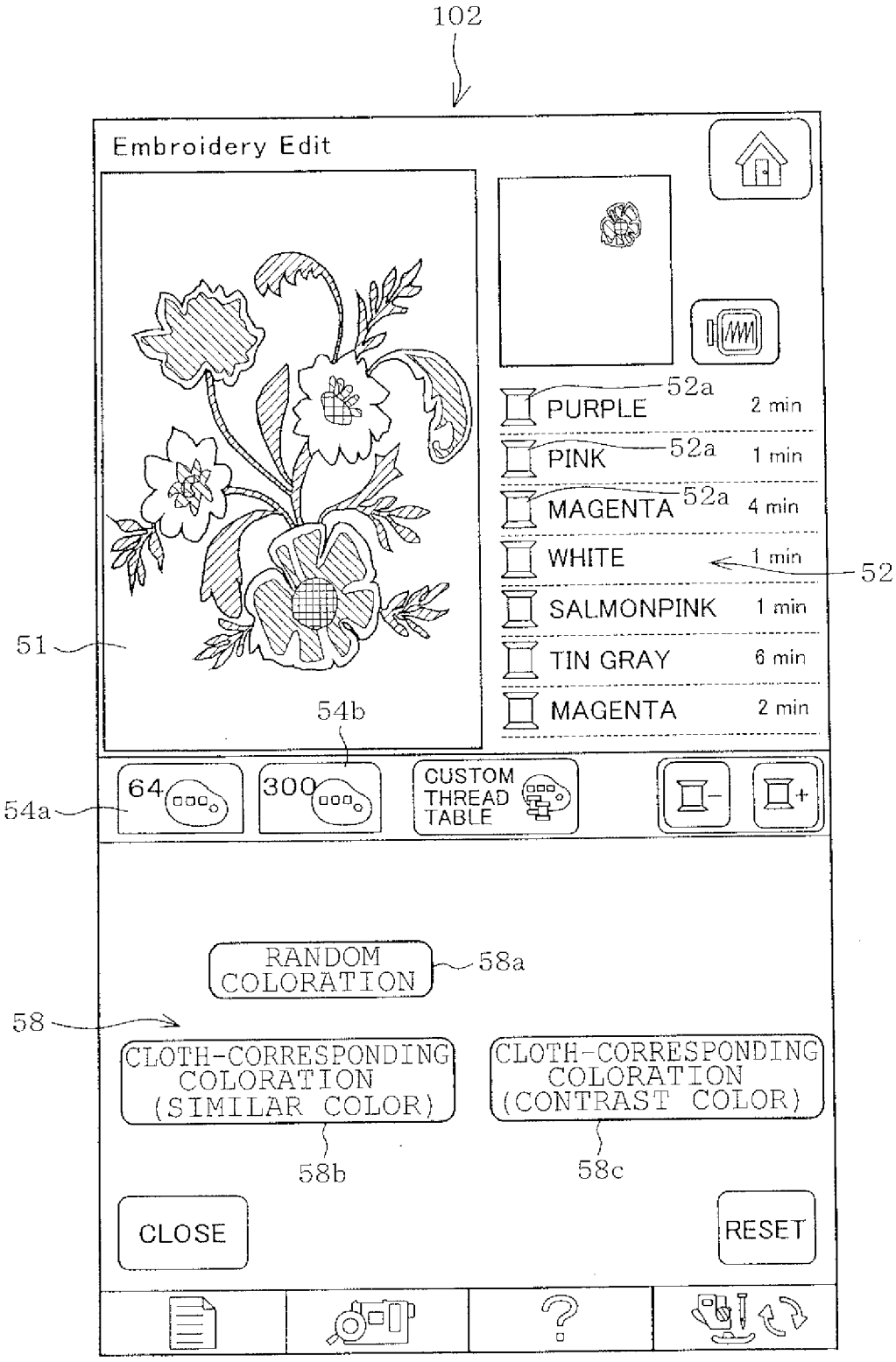
FIG. 7 illustrates a mode setting screen.

A second color change screen provided with a second color pallet is prepared separately from the first color change screen although not shown. The second color pallet of the second color change screen has 300 squares capable of arranging up to 300 colors in 300 squares on the basis of the RGB values of the color information. The second color pallet thus corresponds to the second pallet table. When either one of a pair of pallet selecting keys 54*a* and 54*b* is touched, the display 9 is switched between the first color change screen 101 and the second color change screen. When the shuffle key 55 is touched, the display 9 is switched to a mode setting screen 102 as shown in FIG. 7.

Figure 8:
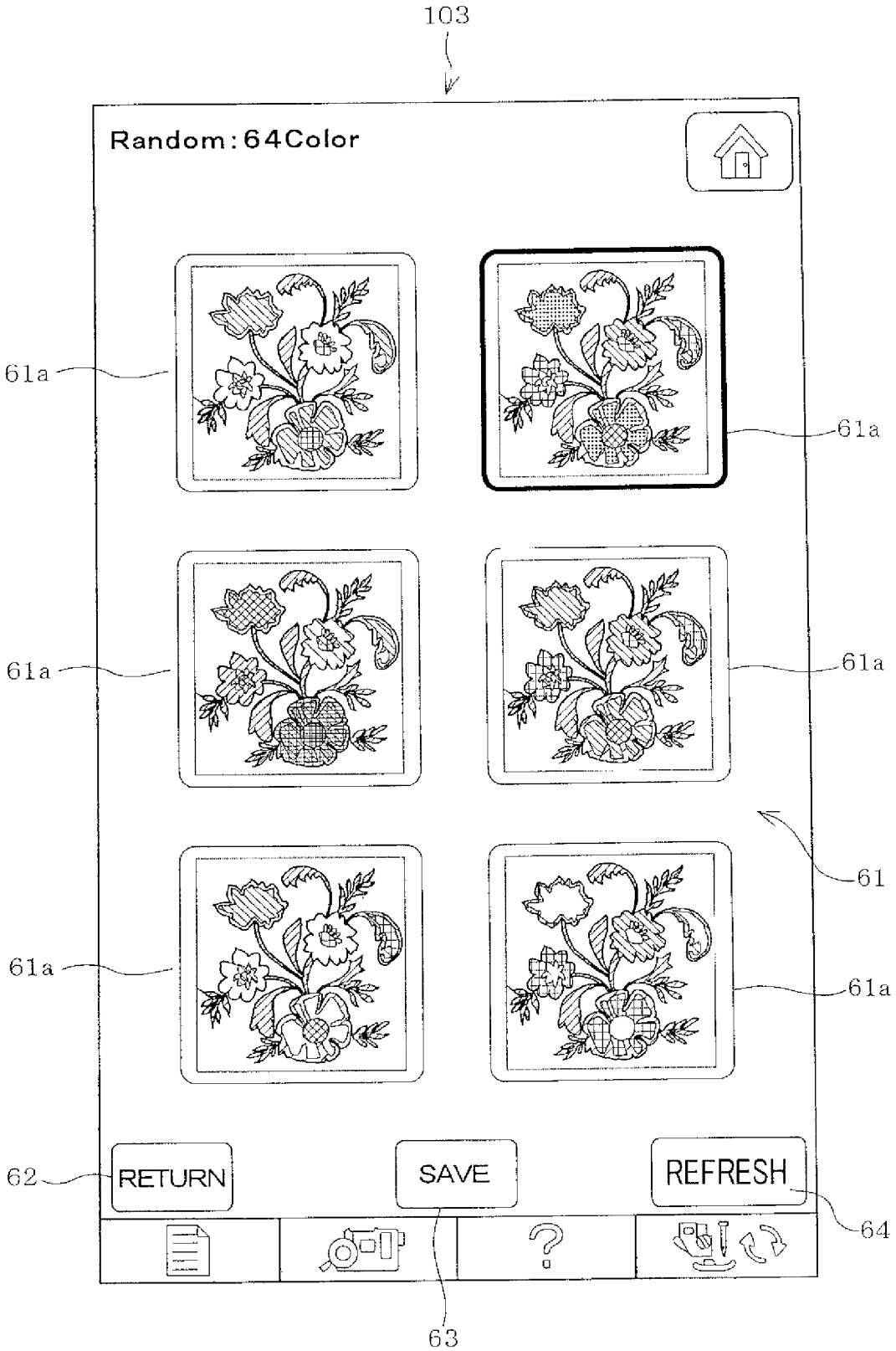
FIG. 8 illustrates a thumbnail display screen.

The mode setting screen 102 is also provided with a preview image area 51 and the like as the first color setting screen 101. However, the mode setting screen 102 is provided with a category setting part 58, instead of the first color pallet 53. The category setting part 58 is provided with keys 58*a*, 58*b* and 58*c* of "random coloration," "cloth-corresponding coloration (similar color)" and "cloth-corresponding coloration (contrast color)" respectively. The random coloration key 58*a* is operated to extract a color at random for every thread color data from one of the pallet tables to thereby execute coloration. Upon touch operation of the key 58*b*, "cloth-corresponding coloration (similar color)" is selected, so that a color is randomly extracted as thread color data from a similar hue table which will be described later. Upon touch operation of the key 58*c*, "cloth-corresponding coloration (contrast color)" is selected, so that a color is randomly extracted as thread color data from a similar hue table which will be described later. Subsequently, the display 9 is switched to a thumbnail display screen 103 as shown in FIG. 8.

The thumbnail display screen 103 is provided with an embroidery pattern selection area 61, a return key 62, a save key 63, a refresh key 64 and the like. The embroidery pattern selection area 61 displays thumbnail images 61*a* obtained by scaling down a plurality of embroidery patterns (six, for example). These thumbnail images 61*a* represent six embroidery patterns differing in the combination of colors generated using the colors randomly extracted as the thread color data. The save key 63 and the thumbnail image 61*a* are touched on the thumbnail display screen 103 in turn. In this case, embroidery data of an embroidery pattern corresponding to the touched thumbnail image 61*a* is stored on the EEPROM 25. Furthermore, upon touch operation of the refresh key 64, newly extracted colors are assigned to the thread color data. As a result, the currently displayed six embroidery patterns are replaced by new six embroidery patterns. Upon touch operation of the return key 62, the display 9 returns to the mode setting screen 102. When one of the thumbnail images 61*a* of the embroidery patterns, for example, a right uppermost thumbnail image in FIG. 8, is touched, the display 9 is switched to an enlarged display screen 104 as shown in FIG. 9.

The enlarged display screen 104 is provided with an enlarged image area 65, a close key 66, a set key 67 and the like. An enlarged embroidery pattern is displayed in the colors assigned by an assignment process in the enlarged image area 65. The enlarged display screen 104 also displays an area other than the embroidery pattern 40, that is, the background is displayed in the color of workpiece cloth CL, based on the image data. Upon touch operation of the close key 66, the display 9 returns to the mode setting screen 102. Furthermore, upon touch operation of the set key 67, the embroidery data of the embroidery pattern is stored on the EEPROM 25 and the display 9 returns to the first color change screen 101.

The control device 21 in the example is configured to assign a color according to the color of the workpiece cloth CL. Accordingly, the control device 21 sets a predetermined extraction range on the basis of color information acquired from the image data. More specifically, the control device 21 calculates HSV values based on the RGB values representing the color of the workpiece cloth CL. The control device 21 then sets thresholds $H_1$ and $H_2$ (see step 36 in FIG. 11) of predetermined hue levels with the obtained hue value H serving as a center value H. The control device 21 further calculates hue values H of 64 colors of the first pallet table or hue values H of 300 colors of the second pallet table. The control device 21 then selects colors which have respective calculated hue values H ranging between thresholds $H_1$ and $H_2$. Thus, similar hue table is generated based on the colors selected from 64 or 300 colors and new corresponding pallet-based color numbers. Use of colors of the similar hue table realizes similar hue coloration. More specifically, for example, the color of the similar hue table presents color gradation such that the color of the similar hue table is within a range from "red" corresponding to threshold $H_1$ to "blue" corresponding to threshold $H_2$ relative to the color of the workpiece cloth CL, for example, "purple."

On the other hand, the control device 21 sets thresholds $H_{R1}$ and $H_{R2}$ of predetermined hue levels (see step B8 in FIG. 11) with a hue value $H_R$ of a color serving as a central value, which color is a complementary to the color of the workpiece cloth CL. In this case, a color whose hue value H ranges from $H_{R1}$ to $H_{R2}$ is selected. A contrast hue table is generated on the basis of thus selected color and a newly corresponding pallet-based color number. The color complementary to the color of the workpiece cloth CL is located at a position spaced 180° away in a hue circle. Accordingly, using the colors in the contrast hue table realizes complementary color combination. In other words, when the workpiece color CL is purple, the color of the contrast hue table presents color gradation in a range between "green" commensurate with the threshold $H_{R1}$ and "yellow" commensurate with the threshold $H_{R2}$. The control device 21 thus generates a color table according to the color of the workpiece cloth CL. The control device 21 thus serves as a hue range setting unit which sets a hue range based on color information obtained from the image data.

The user touches keys 58*a* to 58*c* of the category setting part 58 as will be described in detail later in the description of operation of the embroidery data processor. The touch operation renders it possible to select a table for the above-described coloration, that is, the category of coloration. In this case, the control device 21 serves as a random number generator which generates a random number using a function including, as argument, the maximum of pallet-based color number of the selected table. The control device 21 then collates a pallet-based color number corresponding with the generated random number to extract a color of the corresponding pallet-based color number. The colors thus extracted in a random manner are assigned as thread color data to the color-based pattern portions 401 to 40*n*.

The operation of the embroidery data processing program will be described with particular attention to coloration relevant to the thread color data with reference to FIGS. 10 to 15. In generating embroidery data with coloration according to the color of the workpiece cloth CL in the sewing machine M, the workpiece cloth CL is held on the embroidery frame 16, which is then set on the carriage 17. The embroidery data processing program is then executed.

FIGS. 10 to 15 are flowcharts showing the processing procedure the control device 21 executes based on the embroidery data processing program. Various setting processes are carried out regarding the embroidery pattern at step A1 in FIG. 10. In this case, the user firstly touches the touch panel 9*a* so that the embroidery data is read from the ROM 23, whereby the control device 21 operates the display 9 to display an embroidery pattern selecting screen (not shown) according to the embroidery data. The user selects a desired one of a plurality of embroidery patterns on the pattern selecting screen by touch operation. The touch operation changes the display 9 to a first color change screen 101 displaying the selected embroidery pattern as shown in FIG. 6.

There is a case where the user does not wish to change the colors of the color-based pattern portions regarding the embroidery pattern in a preview image area of the first color change screen 101. In this case, the user designates the colors of the thread spools 52*a* displayed in the corresponding thread color data designating area 52 by touch operation. The colors designated in this manner are stored in an extracted data storage area 249. An upper limit of designated number of colors equals the total number of color-based pattern portions of the embroidery pattern (corresponding to "n" in FIG. 5). Accordingly, the process ends when color designation has been carried out with respect to all the color-based pattern portions at step A1 although the ending is not shown.

Thread color data corresponding to the thread spools 52*a* in the thread color data designating area 52 can be designated using the first color pallet 53 or the second color pallet. In this case, the second color pallet (second color change screen) can be displayed when a pallet selection key 54*b* is touched on the first color change screen 101. When a shuffle key 55 is then touched, the display 9 transits from the first color change screen 101 or the second color change screen to a mode setting screen 102.

Figure 11:
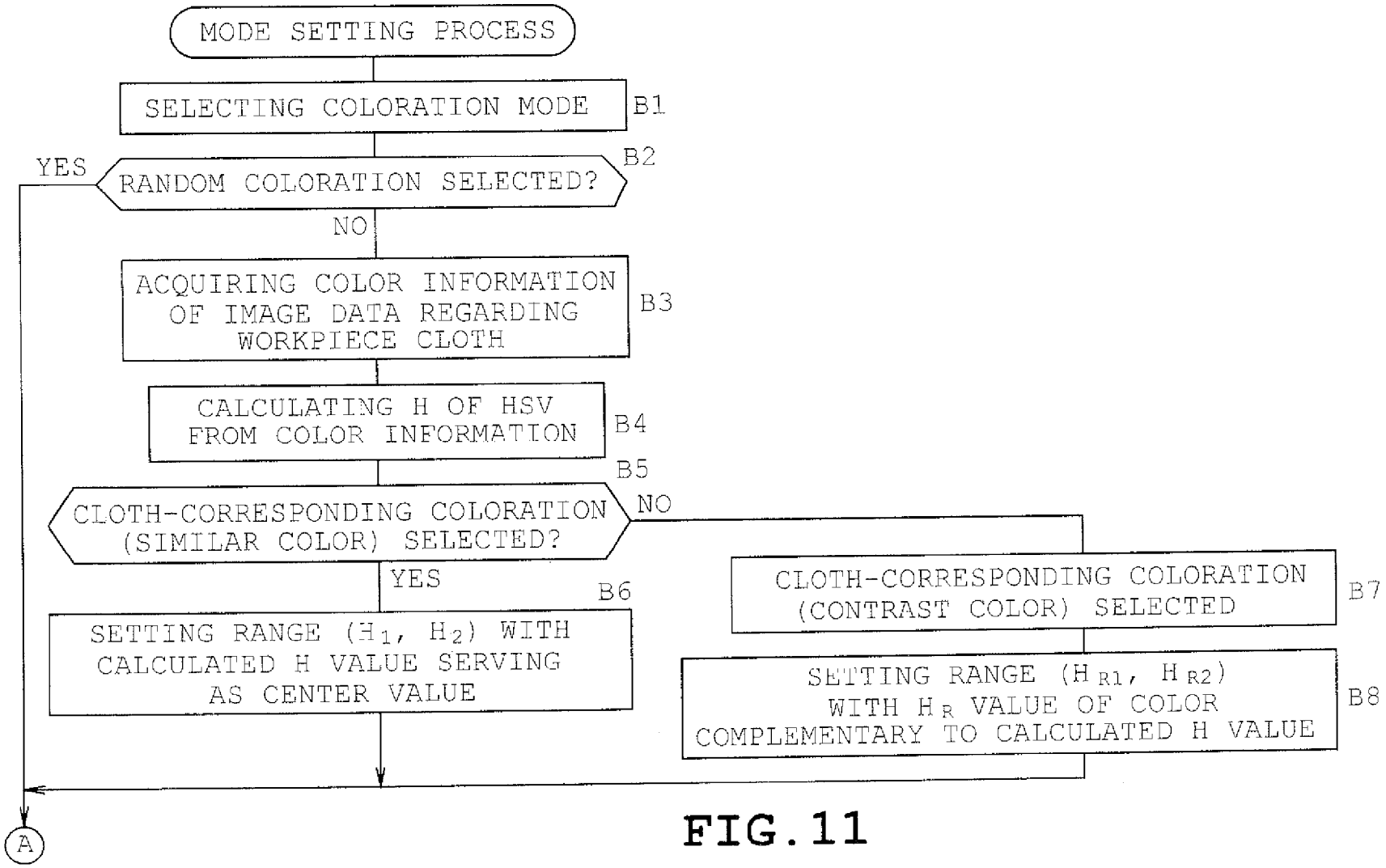
FIG. 11 is a flowchart showing a table setting process (No. 1)

Processing to set a mode to be used is carried out at step A2 (see FIG. 11). More specifically, three keys 58*a*, 58*b* and 58*c* are displayed on the mode setting screen 102. The keys 58*a* to 58*c* designate "random coloration," "cloth-corresponding coloration (similar color)" and "cloth-corresponding coloration (contrast color)" respectively. Any one of the keys 58*a* to 58*c* is touched on the mode setting screen 102 at step B1, whereby one of coloration modes is selected. When the key 58*b* or 58*c* is touched, it is determined at step 22 that a mere random coloration is not selected (NO). In this case, the workpiece cloth CL within the embroidery frame 16 is imaged by a camera 20 while the embroidery frame 16 assumes a predetermined shooting position (step B3). Image data obtained by the camera 20 is processed by an image processing circuit 20*a* so that RGB values are obtained, and other processes are carried out. The image data is then supplied to the control device 21.

The control device 21 then calculates HSV values based on the obtained RGB values (step B4). Furthermore, the control device 21 sets a threshold to be used for coloration according to the mode selected at step B1 (step B5 and subsequent steps). More specifically, when "cloth-corresponding coloration (similar color)" has been selected (YES at step B5), the control device 21 sets a range (thresholds $H_1$ and $H_2$) with the hue value H serving as a center value with respect to the calculated HSV values (step B6). On the other hand, when determining in the negative at step B5, the control device 21 determines at step B7 that "cloth-corresponding coloration (contrast color) has been selected. In this case, the control device 21 sets a range (thresholds $H_{R1}$ and $H_{R2}$) with the hue value $H_R$ serving as a center value (step B8). The hue value $H_R$ is complementary to the hue value H.

Figure 12:
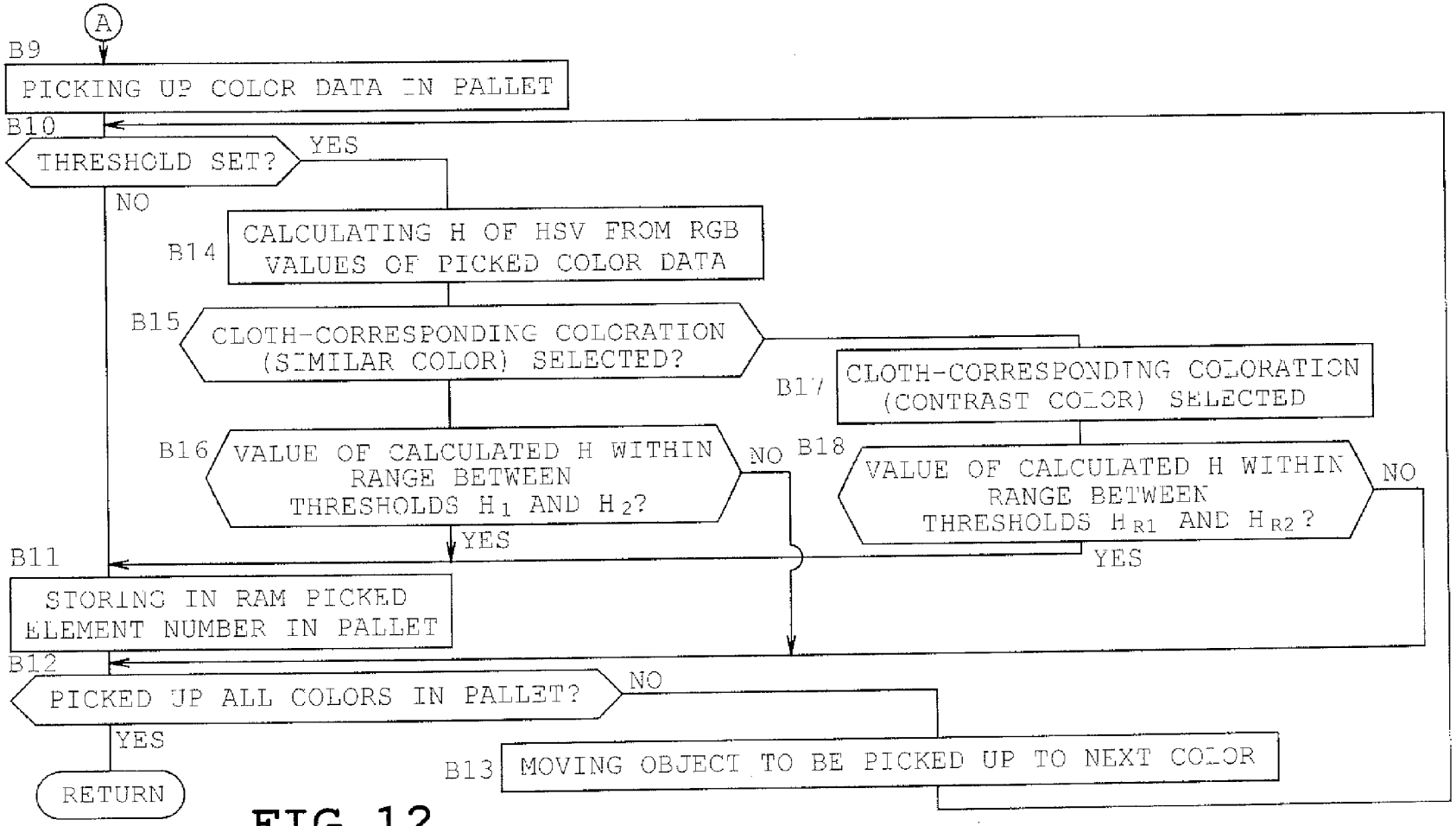
FIG. 12 is a flowchart showing the table setting process (No. 02)

When the aforesaid first color pallet 53 is set as a pallet to be used for coloration at step B9 in FIG. 12, for example, RGB values corresponding to the pallet-based color number 1 are read. In other words, when the display 9 transits from the first color change screen 101 to the mode setting screen 102 at step A1, RGB values of pallet-based color number 1 in the first pallet table are read. When determining that none of the thresholds $H_1$, $H_2$, $H_{R1}$ and $H_{R2}$ have been set (NO at step B10), the control device 21 stores RGB values of pallet-based color number 1 in a color information storage area 246 (step B11). Regarding a color of pallet-based color number 2 (NO at step B12, step B13), too, RGB values are read and stored in the color information storage area 246 in the same manner as pallet-based color number 1 (steps B10 and B11). In the random coloration having unset thresholds $H_1$, $H_2$, $H_{R1}$ and $H_{R2}$, sixty-four colors of the first color pallet 53 are repeatedly carried out (steps B10 to B13). As a result, the first pallet table is held in the color information storage area 246 without change, and the control device 21 then returns to step A3 in FIG. 10 (YES at step B12).

When determining at step B10 that the thresholds $H_1$, $H_2$, $H_{R1}$ and $H_{R2}$ have been set (YES), the control device 21 calculates a hue value H based on RGB values of pallet-based color number 1 (step B14). When determining that the calculated hue value H is the cloth-corresponding coloration (similar color; and YES at step B15), the control device 21 then determines whether or not the hue value H is within a range between the thresholds $H_1$ and $H_2$ (step B16). Assume now that the control device 21 determines that the hue value H is within the range between the thresholds $H_1$ and $H_2$ regarding the color of pallet-based color number 1 (YES at step B16). That is, the color of pallet-based color number 1 is stored in the color information storage area 246 (step B11) when the color and hue of the workpiece cloth CL are similar to the color of pallet-based color number 1.

On the other hand, assume that the control device 21 determines that the hue value H is out of the range between the thresholds $H_1$ and $H_2$ (NO at step B16). In this case, the control device 21 proceeds to step B12 without storing the color of pallet-based color number 1 in the color information storage area 246. Regarding the color of pallet-based color number 2 (NO at step 612; and step B13), the control device 21 also calculates a hue value H based on read RGB values (step B14) in the same manner as the color of pallet-based color number 1. The control device 21 determines whether or not the hue value H is within the range between the thresholds $H_1$ and $H_2$ regarding the color of pallet-based color number 2 and further determines whether or not the color of pallet-based color number 2 is stored in the color information storage area 246 (step B16). Thus, in the case of the cloth-corresponding coloration (similar color), the control device 21 repeatedly executes steps B10, B14 to B16, B12 and B13 regarding the sixty-four colors in the first color pallet 53. Every time determining in the affirmative at step B16 in the course of repetition, the control device 21 stores the color concerned at step B11. As a result, the first pallet table is updated as a similar hue table of selected colors to which the color and hue of the workpiece cloth CL are similar. Additionally, the first pallet table is stored in the color information storage area 246 with the updated pallet-based color numbers.

When determining at step B10 that the thresholds have been set (YES) and at step B15 that the calculated hue value H is not set at the cloth-corresponding coloration (similar color) (NO), the control device 21 determines that the hue value H is set at the cloth-corresponding coloration (contrast color) (step B17). Furthermore, the control device 21 determines whether or not the hue value H of pallet-based color number 1 calculated at step B14 is within the range between thresholds $H_{R1}$ and $H_{R2}$. When determining that the hue value H of the color of pallet-based color number 1 is within the range between thresholds $H_{R1}$ and $H_{R2}$ (YES at step B18), the control device 21 stores the color in a color information storage area 246 (step B11). In this case, the color to be stored is substantially complementary to the color of the workpiece cloth CL.

Regarding the color of pallet-based color number 2 (NO at step B12; and step B13), the control device 21 also calculates a hue value H based on read RGB values (step B14) in the same manner as the color of pallet-based color number 1. The control device 21 determines whether or not the hue value H is within the range between the thresholds $H_1$ and $H_2$ regarding the color of pallet-based color number 2 and further determines whether or not the color of pallet-based color number 2 is stored in the color information storage area 246 (step B18). Thus, in the case of the cloth-corresponding coloration (contrast color), the control device 21 repeatedly executes steps B10, B14, B15, 317, B18, B12 and B13 regarding the sixty-four colors in the first color pallet 53. Every time determining in the affirmative at step B18 in the course of repetition, the control device 21 stores the color concerned at step B11. As a result, the first pallet table is updated as a contrast hue table of selected colors with which the color and hue of the workpiece cloth CL contrast. Additionally, the first pallet table is stored in the color information storage area 246 with the updated pallet-based color numbers.

The control device 21 returns to step A3 in FIG. 11 when having completed selection regarding the sixty-four colors in the first color pallet 53 (YES at step B12). When the second color pallet has been set as a pallet used for coloration, the same processing as for the first color pallet 53 is executed at steps B1 to B18. In the following description, reference symbol "p" designates the total number of colors in the table in the first color pallet 53 (or the second color pallet) after update of the pallet table, that is, after step B12.

Figure 13A:
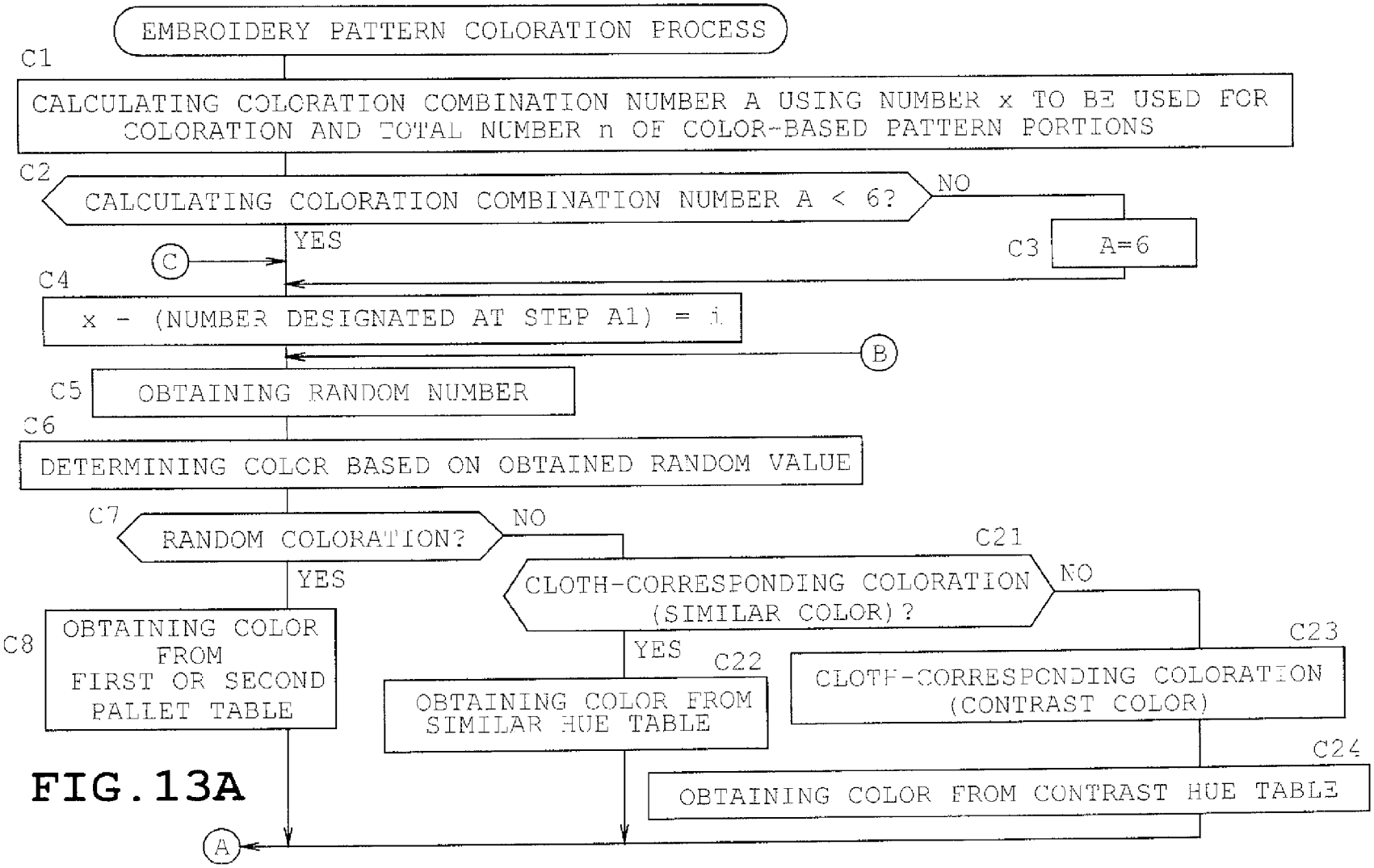
FIGS. 13A and 13B are flowcharts showing a color extraction process and an allocation process.

The extraction process and the coloration process are carried out on the basis of the above-described various settings regarding the selected embroidery pattern at step A3 (see FIG. 13A). In this case, the control device 21 firstly calculates the number A of combinations in the coloration of the selected embroidery pattern at step C1. The combination number A is calculated based on the total number n of color-based pattern portions in the selected embroidery pattern and the number of colors used for the color-based pattern portion (set coloration number x), for example. The set coloration number x in the embodiment is the total number of types of thread color data in the embroidery data. Accordingly, the set coloration number x equals the total number n (x=n) when the colors of the color-based pattern portions differ from each other. A color number setting part (not shown) provided for the user to enter the set coloration number x may be displayed on the display 9 (screen). Thus, the calculating manner may be modified appropriately.

Six embroidery patterns differing from one another in coloration are displayed on the thumbnail display screen 103 in the embodiment, for example. Accordingly, the combination number A necessary for the above-mentioned displaying manner is obtained using combination so that duplication is avoided. For example, when the set coloration number x is 1 and the total number n of color-based pattern portions is 1, the combination number A is designated as ${}_pC_1$. The combination number A of coloration of an embroidery pattern thus bears a proportional relationship to the total number p of colors in the pallet table. Furthermore, when the total number p is equal to or larger than 2 and the set coloration number x is equal to or larger than 3, the combination number A becomes equal to or larger than 6. In this case, the control device 21 determines in the negative at step C2 (NO), whereby the combination number A is set so that six embroidery data are generated (step C3). When the combination number A calculated at step C1 is less than 6 (YES at step C2), the corresponding number of embroidery data is generated.

At step C4, the number of color-based pattern portions the colors of which are not desired to be changed is subtracted from the set coloration number x. As a result, the number i of types of colors to be extracted in one embroidery pattern is calculated. The control device 21 then generates a random number in a range of the total number p of colors of the table in the color information storage area 246. For example, when the first color pallet 53 is set as a pallet to be used for coloration and "random coloration" is set, the control device 21 generates random numbers of 1 to 64 (step C5). Subsequently, the control device 21 extracts colors in a random manner based on the obtained random numbers and set first pallet table (steps C6 to C8). In more detail, when the "random coloration" mode has been set (YES at step C7), the control device 21 collates pallet-based color numbers of 1 to 64 of the first pallet table corresponding with the generated random numbers. The control device 21 then extracts a color (RGB values) corresponding to the pallet-based color number concerned (step C8). When the extracted color does not overlap the color designated at step A1 (YES at step C9), the control device 21 stores the extracted color in the extracted data storage area 249 of the RAM 24 (step C10).

Thus, every time storing the extracted color in the extracted data storage area 249, the control device 21 updates the color type number i to i=i−1 (step C11). The control device 21 also executes steps C5 to C9 regarding extraction of second and subsequent colors (YES at step C12). When extracted second and subsequent colors do not overlap the already extracted colors or the colors designated at step A1 (YES at step C9), storage of the colors and subtraction of color type number i are carried out in the same manners as the first color. The control device 21 repeats the steps C5 to C12 until the control device 21 determines that the subtracted color type number i is not more than 0 (NO at step C12). As a result, in the extracted data storage area 249 are stored the colors used in one embroidery pattern, that is, the colors designated at step A1 and the colors extracted at steps C5 to C12 without overlap.

The control device 21 then calculates the deficiency number T that is the difference between the total number n of color-based pattern portions and the set coloration number x (step C13). When the deficiency number T is left (NO at step C14), the control device 21 transfers to an additional selecting process (step C15).

Figure 14:
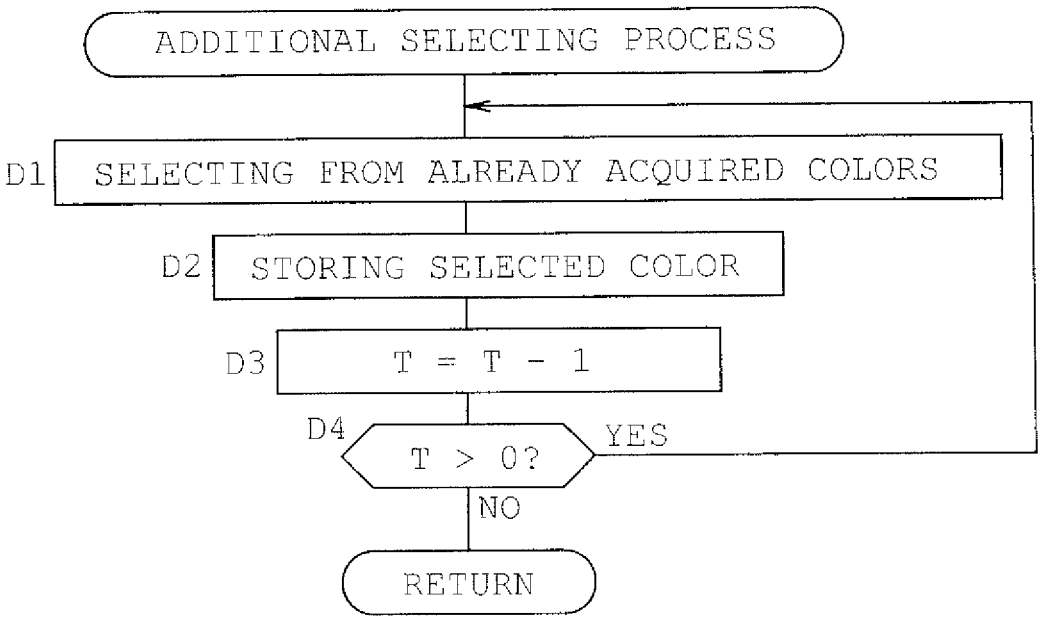
FIG. 14 is a flowchart showing additional selecting process.

More specifically, as shown in FIG. 14, a color is selected from the extracted data storage area 249 at step D1 of the additional selecting process. The additional selection is carried out in order that the number n of color-based pattern portions may equal the number of colors in the extracted data storage area 249 as premises for the coloration process. The control device 21 generates random numbers within a range of the total number of colors stored in the extracted data storage area 249 in the same manner as described above. A color can randomly be selected from the colors stored in the extracted data storage area 249 using the random numbers. A selected color is additionally stored in the extracted data storage area 249 (step D2). The deficiency number T is updated to T=T−1 (step D3). The control device 21 repeatedly executes steps D1 to D4 until the control device 21 determines that the deficiency number T is reduced to zero. As a result, the colors the number of which equals the total number n of color-based pattern portions are stored in the extracted data storage area 249. When the number of colors in the extracted data storage area 249 corresponds with the total number n of color-based pattern portions (NO at step D4 or YES at step C14), the control device 21 proceeds to a coloration process (step C16).

Figure 15:
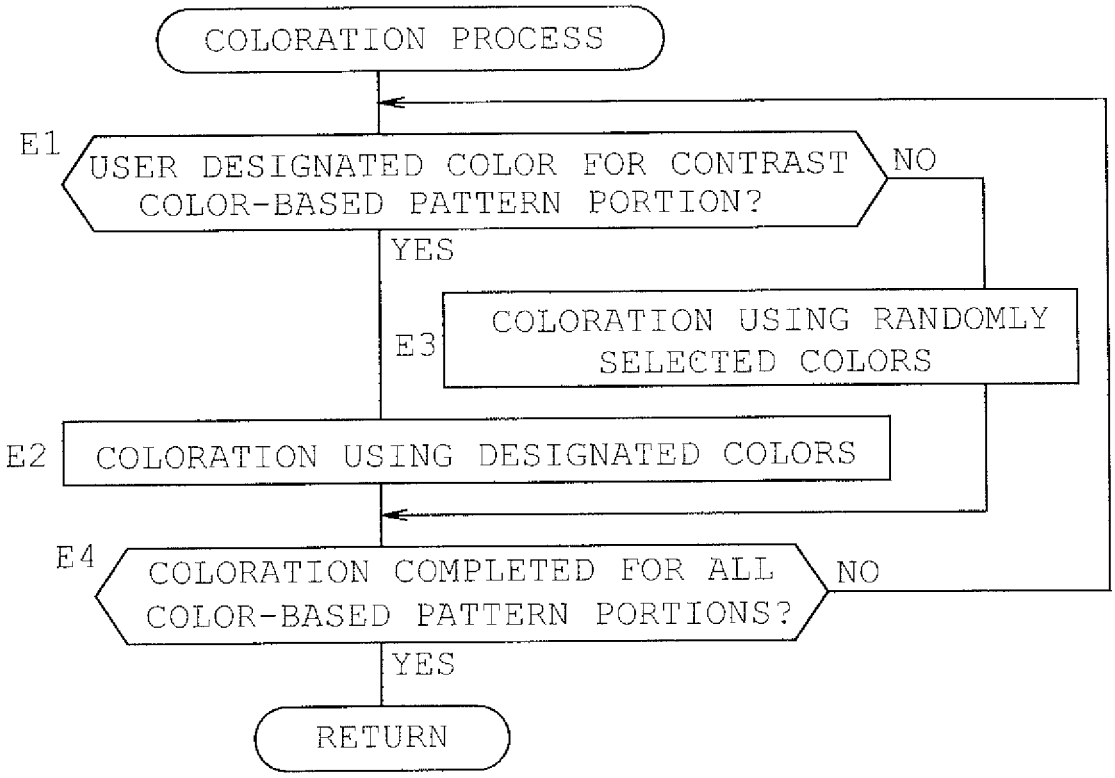
FIG. 15 is a flowchart showing a color combination process for every embroidery pattern.

In the coloration process, the control device 21 determines whether or not the user has designated a color (designation at step A1) for every thread color data of color-based pattern portion (step E1), as shown in FIG. 15. When there is user's color designation regarding each thread color data, the color concerned is assigned (step E2). On the other hand, when there is no user's color designation, a randomly selected color is assigned (step E3). Colors stored in the extracted data storage area 249 are shuffled in the assignment. More specifically, the control device 21 executes a sorting process to rearrange a plurality of colors stored in the extracted data storage area 249 even when the aforesaid additional selecting process is carried out and overlapped data of color is stored in the extracted data storage area 249. This ensures randomicity in coloration. Thus, steps E1 to E4 are repeatedly carried out at the number of times corresponding to the number n of color-based pattern portions. Upon completion of coloration, the control device 21 returns to step C17 in FIG. 13A.

When the coloration of a first embroidery pattern is completed by the above-described process, all the thread color data is stored in the RAM 24 (YES at step C17; and step C18). The control device 21 then updates the combination number A to A=A−1 (step C19), returning to step C4 (YES at step C20). Furthermore, steps C4 to C17 are executed regarding coloration of second or subsequent embroidery patterns. When coloration of the second and subsequent embroidery patterns differs from previously generated coloration of embroidery patterns (YES at step C17), the control device 21 executes storage of thread color data and subtraction of combination number A in the same manners as in the first embroidery pattern (steps C18 and C19). The control device 21 repeatedly executes steps C4 to C20 until the control device 21 determines that combination number A is not more than 0 (NO at step C20). As a result, the control device 21 generates the combination of A-number of embroidery patterns having different coloration. Subsequently, the control device 21 returns to step A4 in FIG. 10.

The following processing is carried out in the case of cloth-corresponding coloration (similar color; and YES at step C21), differing from that in the random coloration (NO at step C7 in FIG. 13A). More specifically, the control device 21 generates random numbers within the range of the total number p of colors in the similar hue table at step C5, randomly extracting color based on the obtained random number (step C6). In this case, the control device 21 collates the pallet-based color number of the similar hue table corresponding with the generated random number. The control device 21 then extracts a color (RGB values) corresponding to the pallet-based color number concerned (YES at step C21 in FIG. 13A; and step C22 in FIG. 13B). In this case, when the extracted color does not overlap the color designated at step A1 (YES at step C19 in FIG. 13B), the control device 21 carries out storage of the color and subtraction of i (steps C10 and C11).

Figure 13B:
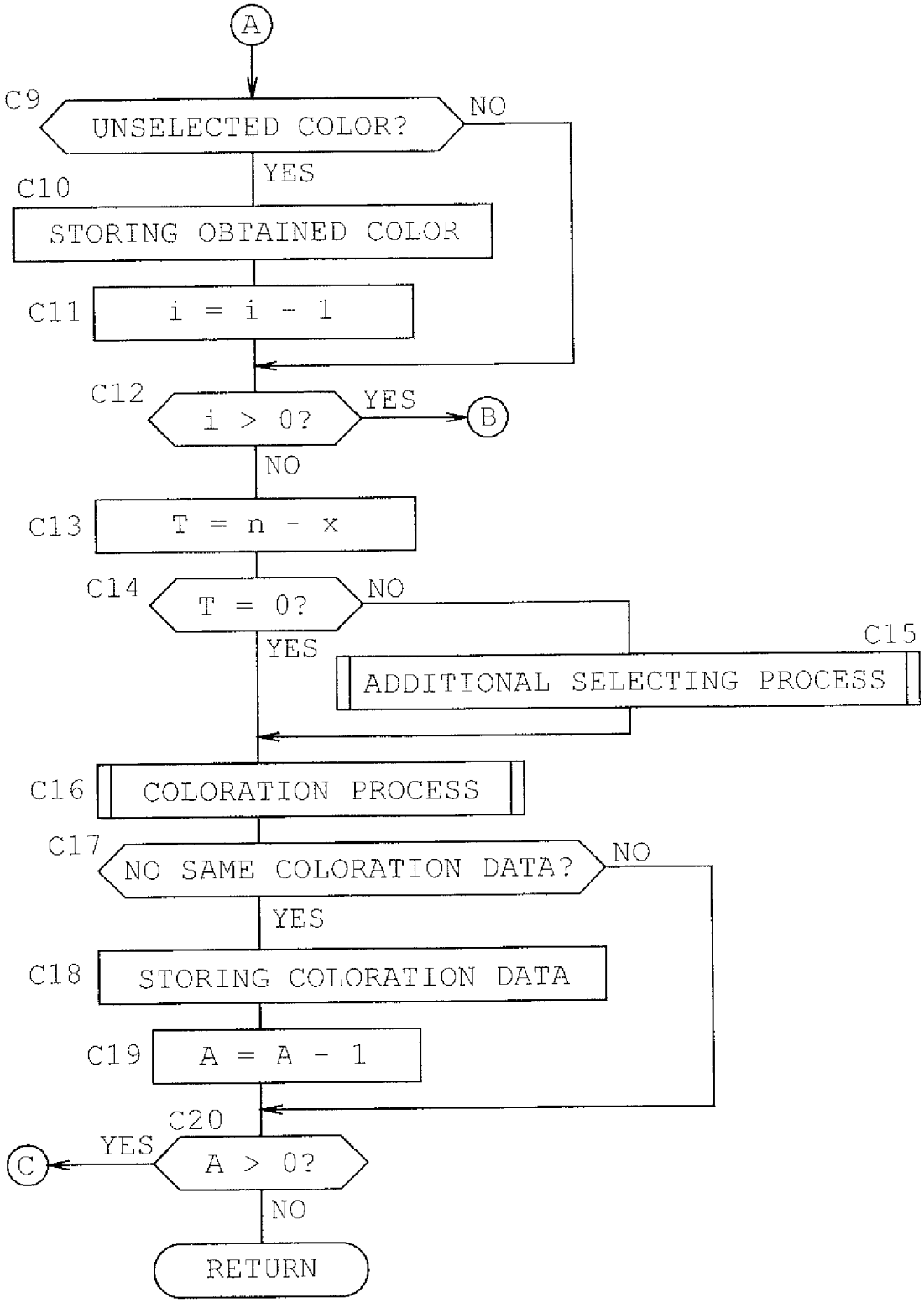

The control device 21 executes steps C5 to C7, C21, C22 in FIG. 13A and C9 in FIG. 13B in each of the second and subsequent color extraction (YES at step C12). When the extracted second or subsequent colors do not overlap the already extracted color or the color designated at step A1 (YES at step C19), the control device 21 carries out storage of the color and subtraction of i (steps C10 and C11) in the same manner as in the first color. The control device 21 repeatedly executes steps C5 to C7, C21, C23, C24 and C9 to C12 until the control device 21 determines that the subtracted color type number i is not more than 0 (NO at step C12). As a result, the extracted data storage area 249 stores the colors used for one embroidery pattern, that is, the colors designated at step A1 and the colors extracted from the contrast hue table without overlap.

The control device 21 further carries out coloration regarding the first embroidery pattern after the additional selecting process and the like by execution of steps C13 to C17. Thus, when completing coloration regarding the first embroidery pattern, the control device 21 stores all the thread color data in the RAM 24 (YES at step C17; and step C18). The control device 21 then updates the combination number A to A=A−1 (step C19), returning to step C4 (YES at step C20). Furthermore, regarding coloration of the second and subsequent embroidery patterns, the control device 21 executes the same processing as the first embroidery pattern. As a result, the combination of A-number of embroidery patterns having different coloration is generated. As described above, colors to be used as thread color data are extracted from the contrast hue table in the case of the cloth-corresponding coloration (contrast color). Accordingly, regarding A-number of embroidery patterns, the control device 21 can carry out a good-looking coloration enhanced using a color substantially complementary to the color of the workpiece cloth CL. The above-described extraction process and the assignment process should not be limited to the above-described manners of steps C1 to C24, D1 to D4 and E1 to E4 but may include at least a step of randomly extracting and assigning the color. The control device 21 then returns to step A4 in FIG. 10 after the extraction and assignment processes.

At step A4, the control device 21 displays on the thumbnail display screen 103 thumbnail images obtained by downscaling A-number of embroidery patterns (six embroidery patterns in FIG. 8). When for example, a top-right thumbnail image 61*a* of embroidery pattern in FIG. 8 is touched, the thumbnail display screen 103 transfers to an enlarged display screen 104 as shown in FIG. 9 (YES at step A5; and step A6). An embroidery pattern obtained by enlarging the selected thumbnail image 61*a* is displayed on the enlarged display screen 104. In this case, the control device 21 controls the display 9 to display an area (background) other than the embroidery pattern 40 in an enlarged image area 65, in the color of the workpiece cloth CL. Thereafter, when the set key 67 is touched, the enlarged display screen 104 returns to a first color change screen 101 displaying the embroidery pattern 40 in the enlarged image area 65 as an embroidery pattern of the preview image (end).

The control device 21 proceeds to step A2 when a return key 62 is touched on the thumbnail display screen 103 (YES at step A7). Since the mode setting screen 102 is displayed at step A2, the coloration process of the embroidery pattern can be re-executed from various setting processes. Furthermore, when a refresh key 64 is touched (YES at step A8), the control device 21 proceeds to step A3 to re-execute the coloration process of the embroidery pattern. As a result, a newly extracted color is assigned to the thread data, and new six embroidery patterns are displayed, instead of the currently displayed six embroidery patterns.

On the other hand, when a save key 63 is touched on the thumbnail display screen 103 (YES at step A9), the control device 21 proceeds to a save mode (step A10). Any one or more of thumbnail images 61*a* are touched in the same mode thereby to be selected. Consequently, embroidery data of the selected embroidery pattern is stored on the EEPROM 25 (step A11).

The above-described steps C1 to C24, D1 to D4 and E1 to E4 serve as an assignment step to randomly extract and assign colors to be used as thread color data. Steps B3 and B4 serve as a color information acquiring step to acquire color information of the workpiece cloth CL.

The sewing machine M can easily generate embroidery data with coloration matching the color of the workpiece cloth held on the embroidery frame 16. Accordingly, the user confirms the generated coloration of the embroidery data on the display 9, replacing the current thread spool with a thread spool 10 necessary for the sewing of the embroidery pattern. The sewing machine M can execute sewing based on the generated embroidery data.

The embroidery data processor 30 according to the embodiment includes the color information acquiring unit which acquires color information of the workpiece cloth CL on which an embroidery pattern is to be sewn. The embroidery data processor randomly extracts and assigns the color used as thread color data specifying the color of the color-based pattern portion from a plurality of colors stored in the color storage unit, for every color-based pattern portion, based on the acquired color information.

According to the above-described configuration, a random coloration can be carried out by assigning the extracted color to the thread color data of color-based pattern portion by the assignment unit. Accordingly, although the coloration is based on the color of the workpiece cloth CL, the coloration that evokes accidentalness or surprise can be applied to an embroidery pattern, with the result that multiple of coloration patterns can be obtained without fixation on prescribed coloration manners. Furthermore, the coloration of the embroidery pattern can easily be carried out with elimination of a troublesome work such as confirmation and designation of thread color data.

The control device 21 and the touch panel 9*a* are configured as a setting unit which sets a predetermined extraction range including a similar or contrast color based on the color information obtained by the color information obtaining unit. The control device 21 is configured to extract a color to be used as thread color data from colors which are included in a plurality of colors stored in the color storage unit and further included in the extraction range set by the setting unit. According to this control manner, the extraction range is set based on the color of the workpiece cloth CL. This gives commonality and variation to the colors of the color-based pattern portions and can achieve a highly-attractive coloration matched with the color of the workpiece cloth CL.

The control device 21 is configured as hue range setting unit which sets a hue range based on the color information acquired by the color information acquiring unit. The control device 21 is configured to extract a color to be used as color data from colors which are included in a plurality of colors stored in the color storage unit and further included in the hue range set by the hue range setting unit. Consequently, an image of embroidery pattern can be rendered different by the set hue range, and the unity of the coloration can be achieved from a whole embroidery pattern.

The display unit is configured to display an embroidery pattern in colors assigned to thread color data of a plurality of partial areas. Consequently, the colors of color-based pattern portions of the generated embroidery data can easily be grasped visually.

The foregoing embodiment should not be restrictive but may be modified or expanded as follows. The embroidery data processor should not be limited to the use with the sewing machine M. For example, the embroidery data processor may be composed of a personal computer as a processor body (which may be a dedicated machine), a mouse, a keyboard, a display all of which are connected to the processor body, and the like. Furthermore, another embodiment may provide the sewing machine M and the embroidery data processor both of which are independent of each other, differing from the foregoing embodiment. In this case, wired or wireless connection may be provided between the sewing machine M and the embroidery data processor for data transmission and reception.

The control device 21 may be configured as a contrasting density range setting unit which sets a threshold regarding a contrasting density based on the color information acquired by the color information acquiring unit. In this case, a color to be used as thread color data is extracted from colors which are included in a plurality of colors stored in the color storage unit and are further within the threshold set by the contrasting density setting unit.

More specifically, for example, the control device 21 executes a process of calculating color saturation S (or color value V) based on the image data regarding color information of the workpiece cloth CL, instead of the processing at the above-described steps B4 to B8. In this case, a predetermined threshold is set on the basis of the calculated saturation S (or the color value V). The threshold set in this case includes an upper limit threshold and a lower limit threshold with the saturation S (or the color value V) serving as a center value. For example, the first pallet table is updated using colors included in a range between the upper and lower limit thresholds thereby to be generated as a color-density-based table. Furthermore, a process is executed of extracting a color used as thread color data, from the color-density-based table. This can generate embroidery data with coloration presenting a delicate shade as a whole without large differences among saturation levels of the color-based pattern portions relative to the color of the workpiece cloth CL.

The control device 21 may further determine a contrasting density of the saturation S (or color value V) obtained on the basis of the image data, set a threshold to extract a relatively deeper color when determining that the workpiece cloth CL is pale.

For example, L* value, a* value and b* value in CIE (1976) L*a*b color system may be used as hue values, instead of the foregoing RGB values or HSV values. The CIE L*a*b color system was prescribed by the International Commission on Illumination in 1976. The L* value indicates luminance and the a* value and b* value indicate chromaticity. For example, when both of the a* value and b* value are 0, an achromatic color is obtained. A brighter color is obtained as values (absolute values) of the a* value and b* value become large. A positive a* value represents a pro-red color. A negative a* value represents a pro-green color. A positive b* value represents a pro-yellow color. A negative b* value represents a pro-blue color. These values of L*, a* and b* can be calculated by a known calculation method on the basis of RGB values.

The control device 21 calculates values of L*, a* and b* based on the RGB values obtained as the color information of the workpiece cloth CL. Thus, the control device 21 may be configured as a hue range setting unit which sets ranges of hue values. In this case, a hue-based table is generated by updating with the colors included within the ranges of hue values in the same manner as the above-described color-density-based table. Colors to be used as thread color data are extracted from colors included in the color-density-based table. As a result, a coloration process according to the color of the workpiece cloth CL can be carried out with respect to each of the values of L*, a* and b*, whereupon highly-attractive embroidery data blending with the color of the workpiece cloth L can be generated.

The storage unit should not be limited to the RAN 24 and the EEPROM 25 but may be another internal storage unit incorporated in the sewing machine or the embroidery data processor or an external storage unit detachably attachable to the sewing machine or the embroidery data processor.

A storage medium storing the embroidery data processing program should not be limited to the ROM 23 but may be may be a USB memory, a CD-ROM, a flexible disc, a DVD, a memory card or the like. In this case, the embroidery data processing program may be read by a computer such as the foregoing dedicated machine to be executed. As a result, this modification can achieve the same operation and advantageous effect each as that achieved by the foregoing embodiment.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An embroidery data processor processing embroidery data on which an embroidery pattern is sewn by a sewing machine, the processor comprising:

a color information acquiring unit configured to acquire color information of a workpiece cloth on which the embroidery pattern composed of a plurality of color-based pattern portions is sewn;

a color storage unit configured to store data of a plurality of defined colors;

an assignment unit configured to randomly extract colors from the colors stored by the color storage unit for every one of the color-based pattern portions, based on the color information acquired by the color information acquiring unit, said extracted colors being used as thread color data specifying colors of the color-based pattern portions respectively, the assignment unit assigning the extracted colors to the respective color-based pattern portions; and a setting unit configured to set a predetermined extraction range containing a similar color or a contrast color based on the color information acquired by the color information acquiring unit, wherein the assignment unit is configured to extract the color stored by the color storage unit in the extraction range set by the setting unit.

2. The processor according to claim 1, wherein the setting unit is configured as a hue range setting unit which sets a hue range, based on the color information acquired by the color information acquiring unit, and the assignment unit is configured to extract the color which is stored by the color storage unit and contained in the hue range set by the hue range setting unit.

3. The processor according to claim 1, wherein the setting unit is configured as a contrasting density range setting unit which is configured to set a threshold of contrasting density, based on the color information acquired by the color information acquiring unit, and the assignment unit is configured to extract the color which is stored by the color storage unit and contained in a range with the threshold set by the contrasting density range setting unit.

4. The processor according to claim 1, wherein the setting unit is configured as a color range setting unit which is configured to set a range of a color value, based on the color information acquired by the color information acquiring unit, and the assignment unit is configured to extract the color which is stored by the color storage unit and contained in the range of the color value set by the color range setting unit.

5. The processor according to claim 1, further comprising a display unit which is configured to display the embroidery pattern in the colors assigned to the thread color data of the respective color-based pattern portions.

6. A non-transitory computer-readable storage medium storing an embroidery data processing program which is used by an embroidery data processor processing embroidery data on which an embroidery pattern is sewn by a sewing machine, the processor being configured to perform the steps comprising:

a color information acquiring step of acquiring color information of a workpiece cloth on which the embroidery pattern composed of a plurality of color-based pattern portions is sewn;

an assignment step of randomly extracting colors from a plurality of colors stored by a color storage unit for every one of the color-based pattern portions, based on the color information acquired in the color information acquiring step, said extracted colors being used as thread color data specifying colors of the color-based pattern portions respectively, said extracted colors being assigned to the respective color-based pattern portions; and a setting step of setting a predetermined extraction range including a similar color or a contrast color based on the color information acquired by the color information acquiring unit, wherein in the assignment step, a color used as the thread color data is extracted from the colors stored in the color storage unit in the extraction range set at the setting step.

7. A sewing machine which is capable of sewing embroidery patterns, comprising:

a color information acquiring unit configured to acquire color information of a workpiece cloth on which the embroidery pattern composed of a plurality of color-based pattern portions is sewn;

a color storage unit configured to store data of a plurality of defined colors;

an assignment unit configured to randomly extract colors from the colors stored by the color storage unit for every one of the color-based pattern portions, based on the color information acquired by the color information obtaining unit, said extracted colors being used as thread color data specifying colors of the color-based pattern portions respectively, the assignment unit assigning the extracted colors to the respective color-based pattern portions; and a setting unit which is configured to set a predetermined extraction range containing a similar color or a contrast color based on the color information acquired by the color information acquiring unit, wherein the assignment unit is configured to extract the color stored by the color storage unit in the extraction range set by the setting unit.

8. The sewing machine according to claim 7, wherein the color information acquiring unit includes an imaging unit which is configured to image the workpiece cloth.

9. The sewing machine according to claim 7, further comprising a display unit which is configured to display the embroidery pattern in the colors assigned to the thread color data of the respective color-based pattern portions.

10. The sewing machine according to claim 8, further comprising a display unit which is configured to display the embroidery pattern in the colors assigned to the thread color data of the respective color-based pattern portions.

* * * * *